US011391429B2

(12) United States Patent
Li et al.

(10) Patent No.: US 11,391,429 B2
(45) Date of Patent: Jul. 19, 2022

(54) VEHICLE LAMP OPTICAL ELEMENT ASSEMBLY, VEHICLE ILLUMINATION MODULE, VEHICLE LAMP, AND VEHICLE

(71) Applicant: HASCO VISION TECHNOLOGY CO., LTD., Shanghai (CN)

(72) Inventors: Cong Li, Shanghai (CN); Weigang Gong, Shanghai (CN); Zhiping Qiu, Shanghai (CN); He Zhu, Shanghai (CN); Dapan Zhang, Shanghai (CN); Hui Li, Shanghai (CN); Rui Nie, Shanghai (CN); Xiaofen Sun, Shanghai (CN); Wenhui Sang, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/415,864

(22) PCT Filed: Apr. 16, 2020

(86) PCT No.: PCT/CN2020/085171
§ 371 (c)(1),
(2) Date: Jun. 18, 2021

(87) PCT Pub. No.: WO2020/233297
PCT Pub. Date: Nov. 26, 2020

(65) Prior Publication Data

US 2022/0074564 A1 Mar. 10, 2022

(30) Foreign Application Priority Data

May 20, 2019 (CN) ..... 201910417075.2
Jun. 25, 2019 (CN) ..... 201910556042.6

(51) Int. Cl.
*F21S 41/26* (2018.01)
*F21S 41/29* (2018.01)
(Continued)

(52) U.S. Cl.
CPC ..... *F21S 41/26* (2018.01); *F21S 41/295* (2018.01); *F21S 41/141* (2018.01); *F21Y 2115/10* (2016.08)

(58) Field of Classification Search
CPC ..... F21S 41/26; F21S 41/295; F21S 41/141
See application file for complete search history.

(56) References Cited

U.S. PATENT DOCUMENTS

2007/0070638 A1 3/2007 Fukawa et al.
2008/0080207 A1 4/2008 Sprecht et al.
(Continued)

FOREIGN PATENT DOCUMENTS

CN 201561363 U 8/2010
CN 107289395 A 10/2014
(Continued)

OTHER PUBLICATIONS

PCT International Search Report and Written Opinion of PCT Application No. PCT/CN2019/0099159, dated Mar. 2, 2022, 9 pages.
(Continued)

*Primary Examiner* — Bryon T Gyllstrom
*Assistant Examiner* — Christopher E Dunay
(74) *Attorney, Agent, or Firm* — Maine Cernota & Rardin

(57) ABSTRACT

A vehicle lighting module comprises a primary optical element and a secondary optical element. The primary optical element comprises at least one light entrance part, a light transmission part, and a light exit part sequentially provided along a light exit direction. Either the optical axes of the light entrance parts on either side of the primary optical element incline towards an optical axis of the secondary optical element and the light exit part is a concave arc surface, or the direction of the optical axis of the light entrance part is the same as that of the optical axis of the
(Continued)

secondary optical element and the horizontal cross-sectional line and/or vertical cross-sectional line of the light exit part is configured as a curved line protruding forward. The vehicle lighting module has a small volume while ensuring light effects, and can be adapted to narrow and compact vehicle lamp modeling.

14 Claims, 28 Drawing Sheets

(51) Int. Cl.
*F21Y 115/10* (2016.01)
*F21S 41/141* (2018.01)

(56) References Cited

U.S. PATENT DOCUMENTS

| | | | | |
|---|---|---|---|---|
| 2009/0067186 | A1* | 3/2009 | Futami | F21S 41/26 362/509 |
| 2009/0262546 | A1* | 10/2009 | Stefanov | F21V 13/04 362/521 |
| 2012/0307511 | A1* | 12/2012 | Cheng | F21S 41/143 362/518 |
| 2013/0223089 | A1* | 8/2013 | Danner | F21S 41/143 362/511 |
| 2014/0204602 | A1* | 7/2014 | Jungwirth | F21S 41/26 362/521 |
| 2016/0102831 | A1* | 4/2016 | Okubo | F21S 41/295 362/512 |
| 2019/0063715 | A1 | 2/2019 | Chen et al. | |
| 2020/0141550 | A1* | 5/2020 | Zhu | G02B 19/0066 |

FOREIGN PATENT DOCUMENTS

| | | | |
|---|---|---|---|
| CN | 204005632 | U | 12/2014 |
| CN | 104272013 | A | 1/2015 |
| CN | 104421714 | A | 3/2015 |
| CN | 204372757 | U | 6/2015 |
| CN | 205640631 | U | 10/2016 |
| CN | 106247255 | A | 12/2016 |
| CN | 206001356 | U | 3/2017 |
| CN | 107002963 | A | 8/2017 |
| CN | 107101154 | A | 8/2017 |
| CN | 108397743 | A | 8/2018 |
| CN | 108506885 | A | 9/2018 |
| CN | 208107675 | U | 11/2018 |
| CN | 109268774 | A | 1/2019 |
| CN | 109340693 | A | 2/2019 |
| CN | 109681838 | A | 2/2019 |
| CN | 109404856 | A | 3/2019 |
| CN | 109539168 | A | 3/2019 |
| CN | 208804624 | U | 4/2019 |
| CN | 208846328 | U | 5/2019 |
| CN | 110173669 | A | 8/2019 |
| CN | 210179518 | U | 3/2020 |
| DE | 10019225 | A1 | 10/2000 |
| DE | 102014207750 | A1 | 10/2015 |
| JP | 2015185533 | A | 10/2015 |
| WO | 20171557706 | A1 | 9/2017 |
| WO | 2020232833 | A1 | 11/2020 |
| WO | 2020258517 | A1 | 12/2020 |

OTHER PUBLICATIONS

PCT International Search Report and Written Opinion of PCT Application No. PCT/CN2019/104574, dated Mar. 19, 2020, 11 pages.

International Search Report and Written Opinion for PCT Application No. PCT/CN2020/085171, dated Jul. 22, 2020, 18 pages.

International Search Report and Written Opinion for PCT Application No. PCT/CN2020/085405, dated Jul. 9, 2020, 11 pages.

* cited by examiner

VEHICLE LAMP OPTICAL ELEMENT ASSEMBLY, VEHICLE ILLUMINATION MODULE, VEHICLE LAMP, AND VEHICLE

CROSS REFERENCE TO RELATED APPLICATIONS

The present application is a national phase application filed under 35 USC § 371 of PCT Application No. PCT/CN2020/085171 with an international filing date of Apr. 16, 2020. Application PCT/CN2020/085171 claims the rights and interests of Chinese patent application 201910417075.2 filed on May 20, 2019, and Chinese patent application 201910556042.6 filed on Jun. 25, 2019. The contents of all of these applications are hereby incorporated by reference into the present application in their entirety for all purposes.

FIELD OF THE INVENTION

The present application relates to vehicle illumination devices, and in particular relates to a vehicle lamp optical element assembly, a vehicle illumination module including the vehicle lamp optical element assembly, a vehicle lamp including the vehicle illumination module, and a vehicle including the vehicle lamp.

BACKGROUND OF THE INVENTION

In the technical field of vehicle lamp illumination, a vehicle lamp module generally refers to a low beam and/or high beam illumination module in an automotive headlamp, and optical components of the vehicle lamp module include light sources, primary optical elements (reflectors, condensers, etc.) and secondary optical elements (usually lenses). With the gradual maturity and stability of the automotive industry, the types of vehicle headlamps are becoming more and more diversified. In terms of the overall performance of the vehicle headlamps, customers have put forward increasingly higher requirements. There is a development trend that vehicle lamps are becoming smaller and narrower, so that the overall appearance of automobiles is more personalized and has more sense of technology. Using the International Auto Show held at the Shanghai International Expo Center in 2019 as an example, vehicle lamps on concept cars and even mass-produced cars shown by many mainstream vehicle companies are narrower and more compact in appearance, and also have a trend of vehicle illumination implemented by a plurality of modules, instead of vehicle illumination implemented by one or two modules with large light emergent surface openings commonly before. A vehicle illumination module in the form of a light source, a light guide and a lens is generally used in the prior art. The volume and light emergent surface opening of this type of vehicle illumination module are large, wherein height (up-down direction) and width (left-right direction) dimensions of the lens opening are generally 40-70 mm, and the length of light guide is generally 40-70 mm, and thus the module is not suitable for vehicle lamps with increasingly compact space. If a size of a vehicle lamp module structure of the prior art adopted is directly reduced, the light effect is lost, resulting in a light shape of the vehicle lamp that does not meet a regulatory requirement. There is an urgent need for corresponding technical solutions in the field to meet this demand.

SUMMARY OF THE INVENTION

In a first aspect, an objective of the present application is to provide a vehicle lamp optical element assembly which, through structural optimization, has a reduced overall size on the premise of ensuring a light effect, to adapt for a narrow and compact vehicle lamp appearance.

In a second aspect, an objective of the present application is to provide a vehicle illumination module which, through structural optimization, has a reduced overall size on the premise of ensuring a light effect, to adapt for a narrow and compact vehicle lamp appearance.

In a third aspect, an objective of the present application is to provide a vehicle lamp, an optical element assembly of which, through structural optimization, has a reduced overall size on the premise of ensuring a light effect, so that the vehicle lamp is narrower and more compact in appearance.

In a fourth aspect, an objective of the present application is to provide a vehicle, wherein an optical element assembly of a vehicle lamp of the vehicle, through structural optimization, has a reduced overall size on the premise of ensuring a light effect, so that the vehicle lamp is narrower and more compact in appearance.

To achieve the above objectives, in an aspect, the present application provides a vehicle lamp optical element assembly, including a primary optical element and a secondary optical element, wherein light can passe through the primary optical element and the secondary optical element successively and then is projected to form an illuminating light shape, the primary optical element includes at least one light entrance part, a light transmission part and a light exit part arranged successively along a light emergent direction, wherein optical axes of the light entrance parts on two sides of the primary optical element are inclined towards directions getting closer to an optical axis of the secondary optical element, and the light exit part is a concave arc surface; or a direction of the optical axis of each light entrance part is the same as the direction of the optical axis of the secondary optical element, and a transverse section line and/or a longitudinal section line of the light exit part are/is configured as a forward protruding arc.

Preferably, the longitudinal section line of the light exit part is gradually curved upward and rearward from a lower boundary of the light exit part of the primary optical element.

Preferably, a lower surface of the primary optical element is inclined rearward and downward with respect to the optical axis of the secondary optical element, with an inclination angle of less than or equal to 15°.

Preferably, a distance between upper and lower surfaces of the primary optical element gradually decreases from rear to front.

In a second aspect, the present application provides a vehicle illumination module, including a radiator, a circuit board, a light source and any vehicle lamp optical element assembly described above arranged successively from rear to front along a light emergent direction, wherein the light source is electrically connected to the circuit board; and the vehicle illumination module further includes a primary optical element holder for supporting the primary optical element, and a secondary optical element holder for supporting the secondary optical element.

Preferably, the secondary optical element and the secondary optical element holder are an integrally formed part.

Preferably, the secondary optical element holder is configured as a light-shielding hood, which is integrally formed with the secondary optical element by double-shot molding.

Preferably, openings are formed between upper and lower ends of the secondary optical element and the secondary optical element holder.

Preferably, the primary optical element holder and the secondary optical element holder are connected in a pluggable manner, so as to fix relative positions of the primary optical element and the secondary optical element, and the secondary optical element holder is fixedly connected to the radiator.

Specifically, the primary optical element holder includes insertion positioning parts formed on two sides of the primary optical element, and the secondary optical element holder is provided with insertion slots capable of inserting the insertion positioning parts.

Specifically, the insertion slots run through a rear end of the secondary optical element holder and extend from rear to front; a front end surface of each insertion positioning part is in contact with a front surface of an inner side of the corresponding insertion slot, and a rear end surface of the insertion positioning part is in contact with a surface of the circuit board; and a top surface of the insertion positioning part is in contact with an upper surface of the inner side of the insertion slot, and a bottom surface of the insertion positioning part is in contact with a lower surface of the inner side of the insertion slot.

Preferably, protruding structures are arranged on surfaces of the insertion positioning parts which are in contact with the insertion slots (221*a*).

Preferably, arc-shaped baffles are arranged at left and right inner sides of a front end of the secondary optical element holder.

Preferably, the radiator is provided with radiator positioning pins, and the primary optical element is provided with primary optical element positioning holes in cooperation with the radiator positioning pins; the number of the primary optical element positioning holes is two, wherein one primary optical element positioning hole is a circular hole in contact with a peripheral surface of the corresponding radiator positioning pin; and the primary optical element is provided with a vent hole that communicates the circular hole with the outside.

Preferably, at least one of an up-down direction dimension and a left-right direction dimension of a light emergent surface of the secondary optical element is smaller than or equal to 35 mm.

Alternatively specifically, the primary optical element holder includes a support frame and a limiting piece, the limiting piece is fixedly arranged on the primary optical element, the support frame is provided with a limiting slot, the limiting piece being cooperatively connected with the limiting slot and fixed relative to the support frame; and the secondary optical element holder is provided with insertion slots, and the primary optical element holder cooperates with the insertion slots in a pluggable manner.

Further, the insertion slots run through a rear end of the secondary optical element holder and extend from rear to front; a front end surface of the support frame is in contact with front surfaces of inner sides of the insertion slots, and a rear end surface of the support frame is in contact with a surface of the circuit board; top surfaces of the limiting pieces are in contact with upper surfaces of the inner sides of the insertion slots; and a bottom surface of the support frame is in contact with lower surfaces of the inner sides of the insertion slots.

Preferably, a clamping part is respectively arranged at the left and right sides of the support frame respectively, and opposite inner side surfaces of the two clamping parts are respectively in contact with left and right side surfaces of the secondary optical element holder.

Specifically, the primary optical element holder and the secondary optical element holder are both fixedly connected with the radiator.

In a third aspect, the present application provides a vehicle lamp, which includes any vehicle illumination module described above.

In a fourth aspect, the present application provides a vehicle, which includes the above-mentioned vehicle lamp.

By using the above-mentioned technical solutions, the present application achieves the following beneficial effects.

1. By adopting a cooperative design of a specific primary optical element and secondary optical element, the vehicle illumination module has a small volume and a small light emergent surface opening size on the premise of ensuring a light effect, and is adaptable to a narrow and compact vehicle lamp appearance, is more personalized and has more sense of technology.

2. In a preferred solution of the present application, the primary optical element holder cooperates with the insertion slots of the secondary optical element, so that the installation space for the primary optical element holder is reduced, thereby achieving the purpose of a smaller size.

3. In a preferred solution of the present application, the arc-shaped baffles are arranged at the front end of the secondary optical element holder, for shielding light that forms stray light after entering the secondary optical element and being emergent, so that the stray light may be eliminated, and a light shape effect is improved.

4. Through the cooperative connection between the primary optical element holder and the secondary optical element holder, the primary optical element and the secondary optical element are assembled into an integral structure, thereby directly determining relative positions of the primary optical element and the secondary optical element, and achieving direct positioning between the primary optical element and the secondary optical element. When the vehicle lamp optical element assembly of the present application is mounted on the circuit board and the radiator, with a fixed assembly positioning relationship between the primary optical element and the secondary optical element, a positioning error therebetween does not occur when the vehicle lamp optical element is assembled together with the circuit board and the radiator, thus ensuring the positioning accuracy and installation reliability of the primary optical element and the secondary optical element, and further ensuring the accuracy and functional stability of the vehicle lamp light shape.

Figure 1:
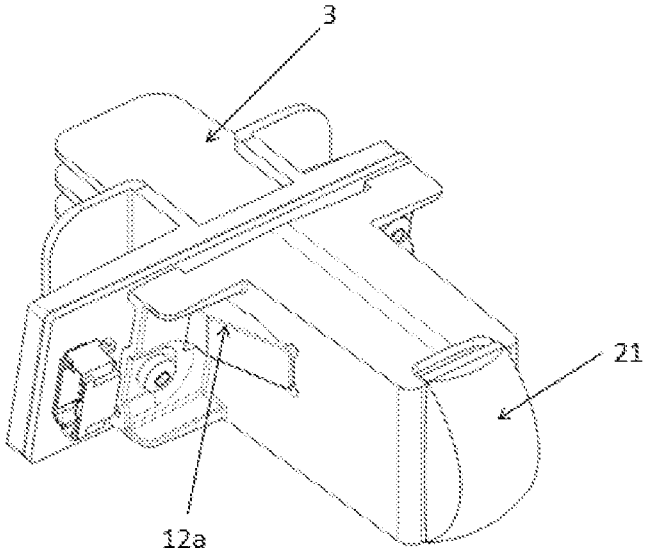
FIG. 1 is a schematic structural diagram of a main low beam module in a specific embodiment of the present application.

| Brief Description of the Symbols: | |
|---|---|
| 11. primary optical element,, | 111. protruding structure, |
| 112. light entrance part, | 1121. cavity, |
| 1122. protrusion, | 113. light transmission part, |
| 114. light exit part, | 115. cutoff part, |
| 116. recessed part, | 117. zone III structure, |
| 1101. insertion positioning part, | 12a/12b/12c. primary optical element holder, |

-continued

| Brief Description of the Symbols: | |
|---|---|
| 121. primary optical element holder mounting hole, | 122. primary optical element positioning hole, |
| 1221. vent hole, | 123b. primary optical element positioning pin, |
| 1201. support frame, | 1202. limiting piece, |
| 1203. limiting slot, | 1204. limiting piece positioning hole, |
| 1205. primary optical element holder positioning pin, | 1206. clamping part, |
| 21. secondary optical element, | 211. optical axis of secondary optical element, |
| 22a/22b/22c. secondary optical element holder, | 221a/221c. insertion slot, |
| 2211a/2211c. front surface, | 2212a/2212c. upper surface, |
| 2213a/2213c. lower surface, | 222a/222b/222c. secondary optical element holder |
| mounting hole, | |
| 223. arc-shaped baffle, | 224a/224b. secondary optical element holder |
| positioning pin, | |
| 225. opening, | 226. through slot, |
| 227. protruding part, | 3. radiator, |
| 31. radiator positioning pin, | 4. circuit board, |
| 41. circuit board primary positioning hole, | 42. circuit board secondary positioning hole, |
| 5. light source, | 6. Screw |

DETAILED DESCRIPTION OF THE EMBODIMENTS

The specific embodiments of the present application will be described in detail below with reference to the accompanying drawings. The specific embodiments described herein are only used for illustrating and explaining the present application, instead of limiting the present application.

First of all, it should be noted that orientation or position relations denoted by some orientation words involved in the following description to clearly explain the technical solutions of the present application, such as the terms "up", "down", "front", "rear", "left" and "right", are same as up, down, front, rear, left and right directions of a vehicle lamp optical element assembly or vehicle illumination module in use. When a vehicle lamp optical element assembly of the present application is mounted on a circuit board 4, a primary optical element 11 is located between the circuit board 4 and a secondary optical element 21, and light emitted by a light source 5 on the circuit board 4 successively passes through the primary optical element 11 and the secondary optical element 21 and then is emergent to form a vehicle lamp illuminating light shape. For description convenience herein, an arrangement direction of the circuit board 4, the primary optical element 11 and the secondary optical element 21 is defined to be from rear to front. That is, the circuit board 4 is behind the primary optical element 11, and the secondary optical element 21 is in front of the primary optical element 11. In a horizontal plane, a direction perpendicular to a front-rear direction is a left-right direction, and in a vertical plane, a direction perpendicular to the front-rear direction is an up-down direction. A "top surface" refers to an upper surface of a component, and a "bottom surface" refers to a lower surface of the component. The above are only intended to facilitate description of the present application and simplify description, instead of indicating or implying that the denoted devices or elements necessarily have specific orientations or are constructed and operated in specific orientations, and thus they should not be interpreted as limiting the present application.

In the present application, an optical axis refers to an axis passing through a focal point of an optical element and extending along a light beam transmission direction of the optical element, that is, a center line of a light beam;

a central area light shape refers to a light shape located in a central area of an illuminating light shape, and a widening area light shape refers to a light shape that reflects the widening of the illuminating light shape, and the two light shapes are superposed to form a complete illuminating light shape;

a main low beam module is a module for forming a light shape of a low beam central area;

an auxiliary low beam module is a module for forming a light shape of a low beam widening area;

a low beam module is a module for forming a low beam light shape, and the low beam light shape includes a light shape of the low beam central area and a light shape of the low beam widening area;

a main high beam module is a module for forming a light shape of a high beam central area;

an auxiliary high beam module is a module for forming a light shape of a high beam widening area;

a high beam module is a module for forming a high beam light shape, and the high beam light shape includes a light shape of the high beam central area and a light shape of the high beam widening area; and a dual-beam module is a high and low beam integrated module for forming low beam and high beam light shapes.

In the description of the present application, it should be noted that the terms "installation" and "connection" should be interpreted in a broad sense unless otherwise clearly specified and defined. For example, the connection may be a fixed connection, a detachable connection, or an integral connection, may be a direct connection, or an indirect connection through an intermediate medium, and may also be a communication within two elements or an interaction between two elements. For those of ordinary skill in the art, the specific meanings of the above terms in the present application may be understood according to specific circumstances.

Figure 78:
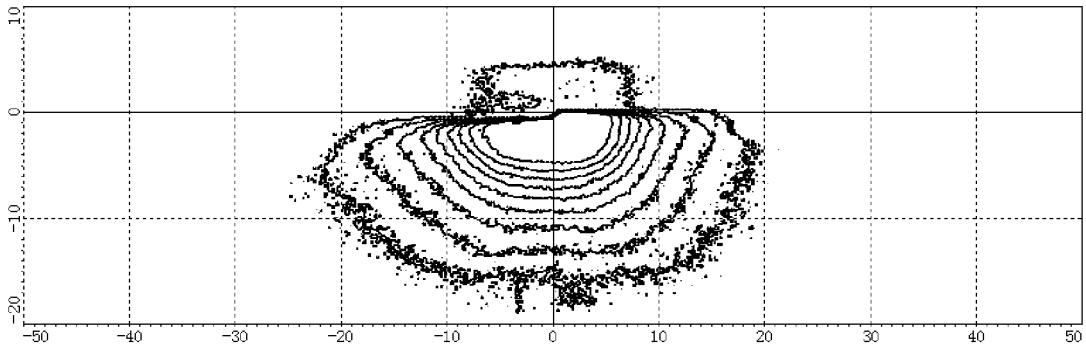
FIG. 78 is a schematic diagram of a light shape formed by projection of superposed main low beam modules I and II in a specific embodiment of the present application.

Referring to FIGS. 1-78, a vehicle lamp optical element assembly of the present application includes a primary optical element 11 and a secondary optical element 21; light can successively passes through the primary optical element 11 and the secondary optical element 21 and then is projected to form an illuminating light shape; the primary optical element 11 includes at least one light entrance part 112, a light transmission part 113 and a light exit part 114 arranged successively along a light emergent direction; light enters the primary optical element 11 from the light entrance parts 112, passes through the light transmission part 113 and then is emergent from the light exit part 114.

Figure 13:
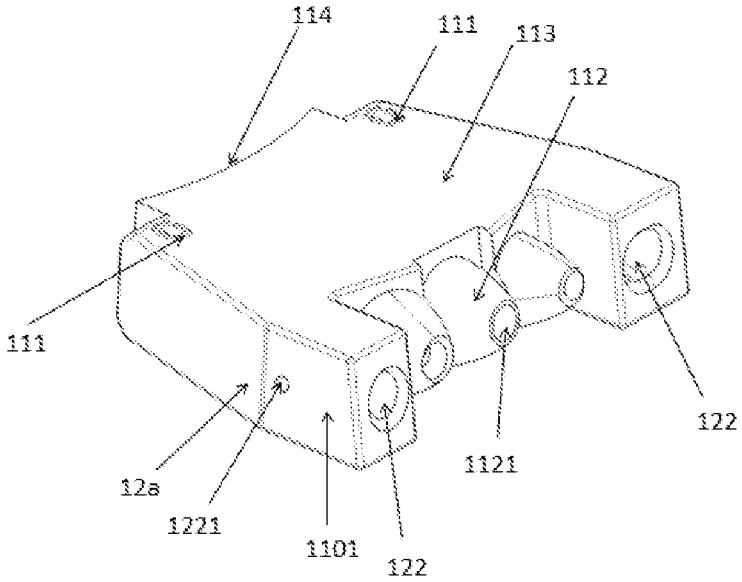
FIG. 13 is a schematic structural diagram of an integrated part of a primary optical element and a primary optical element holder of a main low beam module in a specific embodiment of the present application as viewed from rear.
Figure 14:
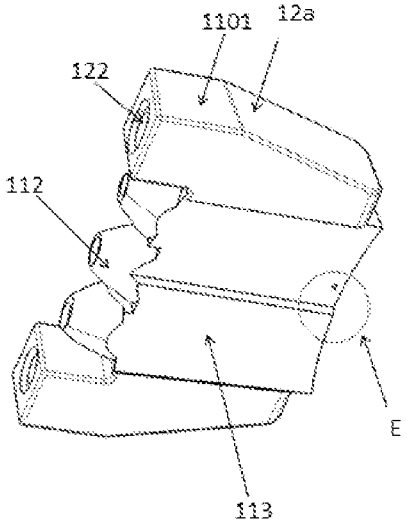
FIG. 14 is a three-dimensional diagram of an integrated part of a primary optical element and a primary optical element holder of a main low beam module in a specific embodiment of the present application as viewed from bottom.
Figure 18:
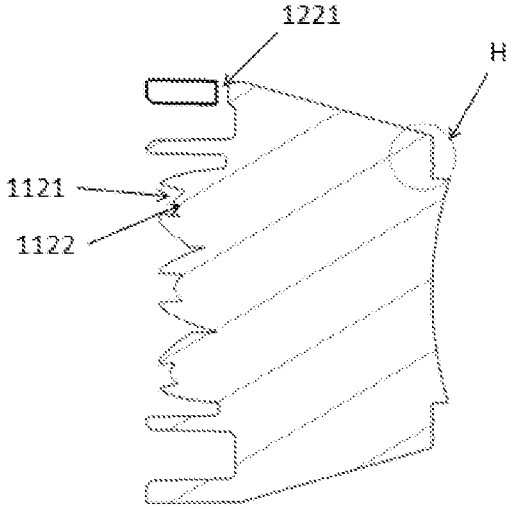
FIG. 18 is a transverse sectional diagram of FIG. 16.
Figure 19:
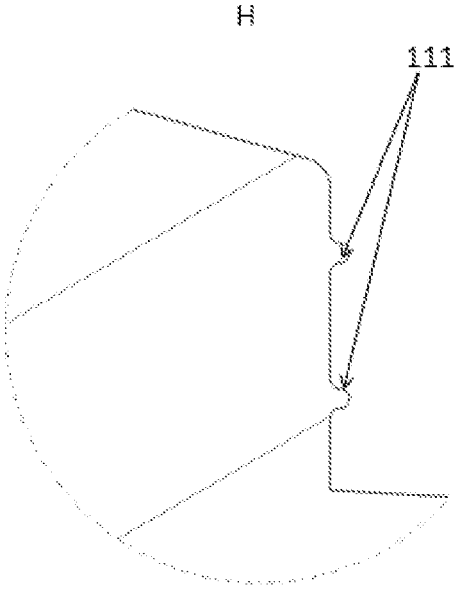
FIG. 19 is an enlarged schematic diagram of H in FIG. 18.

The light entrance parts 112 may be of light condensing structures in various forms. For example, the light entrance parts 12 may be of a condenser-cup-like structure as shown in FIGS. 13-14, or a protruding structure protruding in a direction away from the light transmission part 113. An outer contour surface of the condenser cup is a curved structure with an aperture gradually increasing from rear to front, and a light incident surface of the condenser cup may be a flat surface, or may also be provided, at a rear end, with cavities 1121 having rearward openings as shown in FIG. 18, a bottom of each cavity 1121 is provided with a protrusion 1122 that protrudes in a direction away from the light transmission part 113 to converge more light and improve an light effect.

Figure 3:
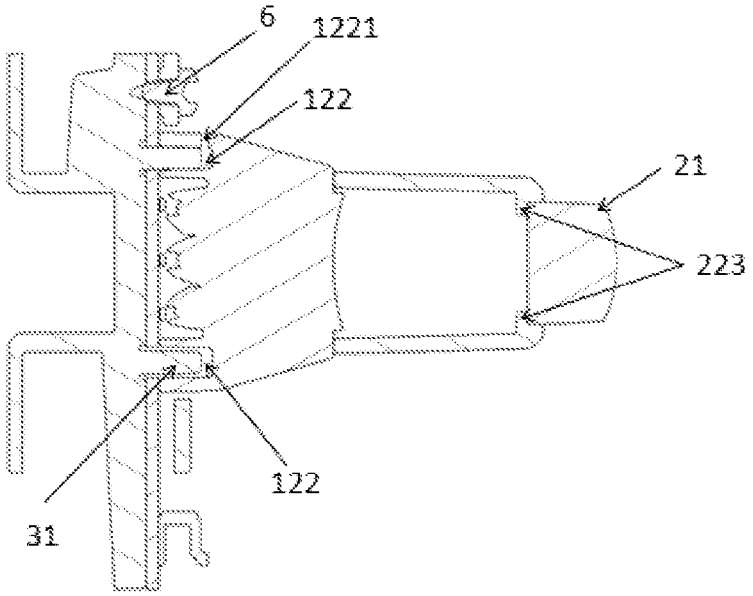
FIG. 3 is a transverse sectional diagram of FIG. 1.
Figure 4:
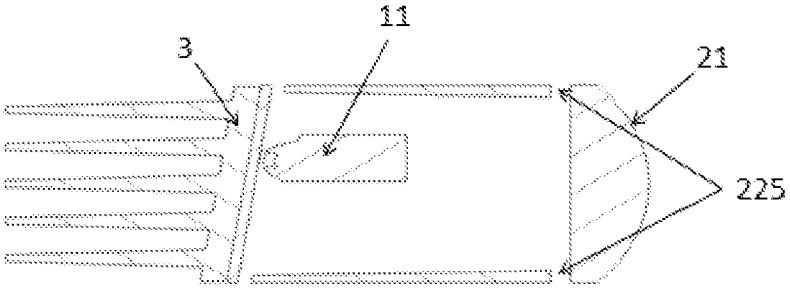
FIG. 4 is a longitudinal sectional diagram of FIG. 1.
Figure 31:
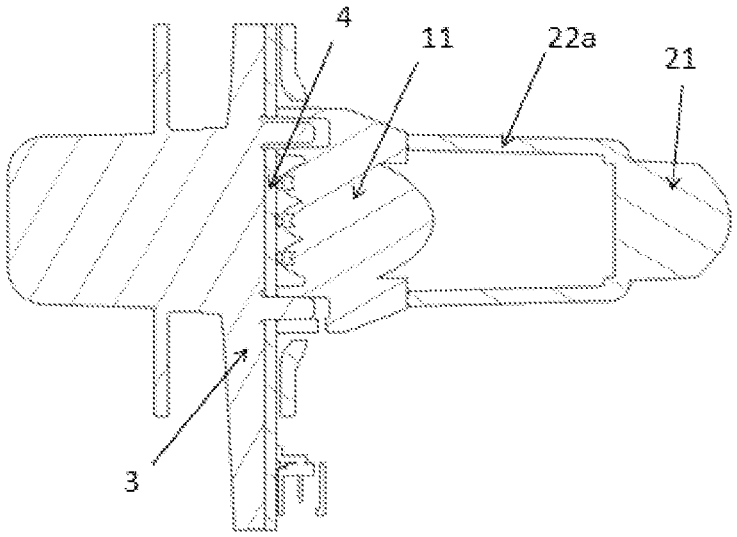
FIG. 31 is a transverse sectional diagram of FIG. 30.
Figure 73:
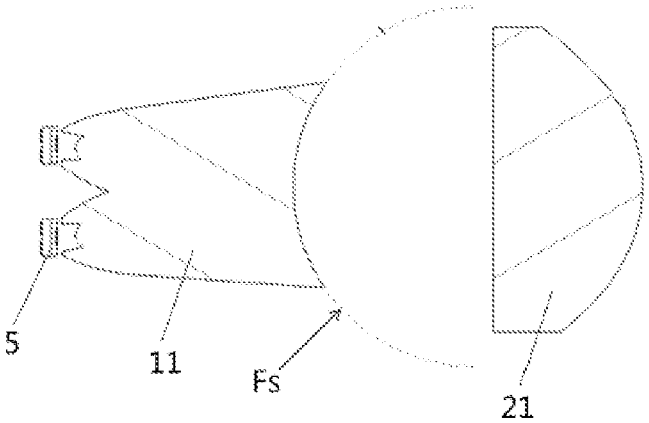
FIG. 73 is a transverse sectional diagram of FIG. 72.
Figure 74:
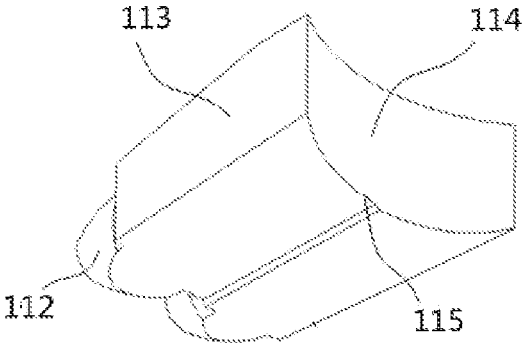
FIG. 74 is a three-dimensional structural diagram of a primary optical element of a main low beam module II in a specific embodiment of the present application.
Figure 75:
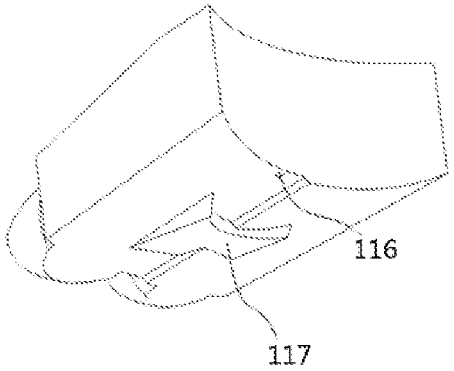
FIG. 75 is a three-dimensional structural diagram of a primary optical element with a zone III structure and a 50 L structure of a main low beam module II in a specific embodiment of the present application.
Figure 76:
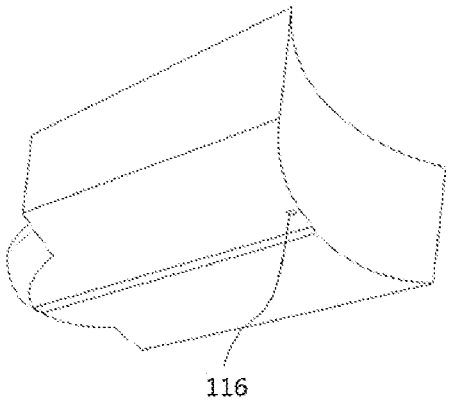
FIG. 76 is a three-dimensional structural diagram of a primary optical element with a 50 L structure of a main low beam module I in a specific embodiment of the present application.

As shown in FIGS. 3 and 73, optical axes of the light entrance parts 112 on two sides of the primary optical element 11 are inclined toward a direction getting closer to an optical axis of the secondary optical element 21, and the light exit part 114 is a concave arc surface; or as shown in FIG. 31, a direction of the optical axis of each light entrance part 112 is the same as a direction of the optical axis of the secondary optical element 21, and a transverse section line of the light exit part 114 is a forward protruding arc, so that light emergent from the light exit part 114 is concentrated toward the middle, to achieve that substantially, the light can enter the secondary optical element 21 with a small width.

Figure 32:
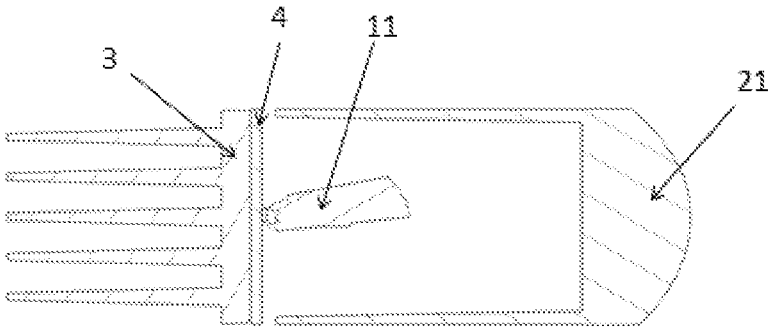
FIG. 32 is a longitudinal sectional diagram of FIG. 30.
Figure 33:
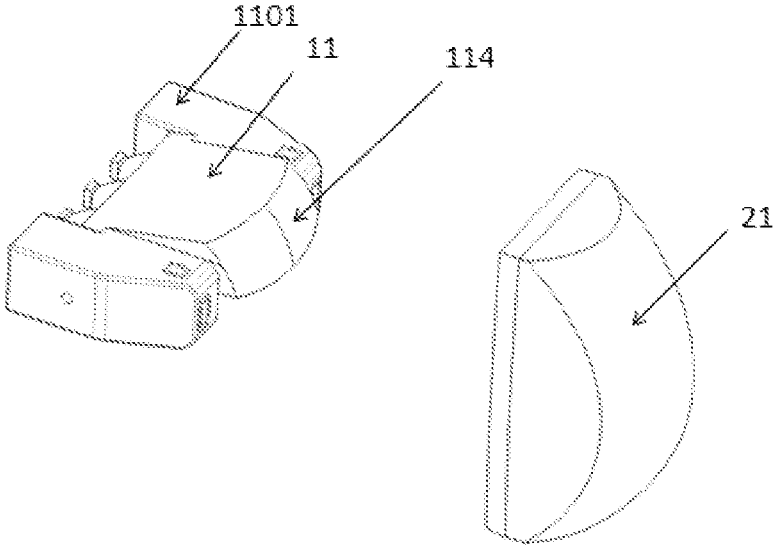
FIG. 33 is an orientation diagram of a primary optical element and a secondary optical element of an auxiliary low beam module in a specific embodiment of the present application.

As shown in FIG. 32, a longitudinal section line of the light exit part 114 is configured as a forward protruding arc, so that the emergent light in the direction is concentrated toward the middle, and a height of the secondary optical element 21 may be small.

Preferably, the longitudinal section line of the light exit part 114 is gradually curved upward and rearward from a lower boundary of the light exit part 114 of the primary optical element 11.

Figure 39:
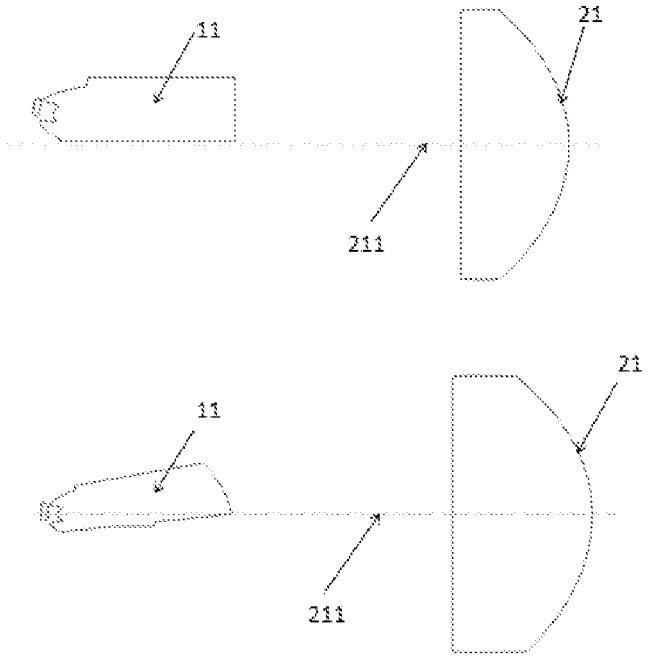
FIG. 39 is a longitudinal section comparison diagram of primary optical elements and secondary optical elements of a main low beam module and an auxiliary low beam module in a specific embodiment of the present application, along respective secondary optical element optical axes.

As shown in FIG. 39, a lower surface of the primary optical element 11 is inclined rearward and downward with respect to an optical axis 211 of the secondary optical element, with an inclination angle of less than or equal to 15°, preferably of 5°-10°, which further allows more emergent light to enter the secondary optical element 21 to improve the light effect.

Figure 54:
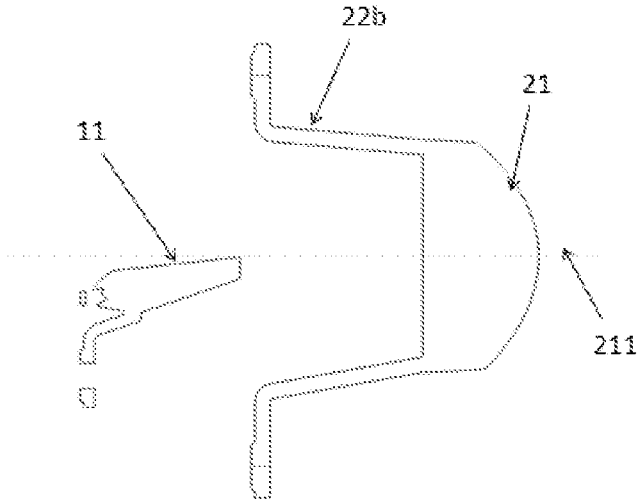
FIG. 54 is a longitudinal sectional diagram of FIG. 52.

As shown in FIG. 54, a distance between upper and lower surfaces of the primary optical element 11 gradually decreases from rear to front, so that light converges in the up-down direction to form a high-brightness light shape.

The above-mentioned vehicle lamp optical element assembly may be applied to various modules, including main low beam modules, auxiliary low beam modules, low beam modules, main high beam modules, auxiliary high beam modules, high beam modules, and dual-beam modules. The difference lies in that vehicle lamp optical element assemblies of different structures are selected according to respective light shape requirements, and corresponding light distribution is performed.

In a second aspect, a vehicle illumination module provided by the present application includes a radiator 3, a circuit board 4, a light source 5 and the above-mentioned vehicle lamp optical element assembly arranged successively from rear to front along a light emergent direction, wherein the light source 5 is electrically connected to the circuit board 4; and the vehicle illumination module further includes a primary optical element holder 12*a* or a primary optical element holder 12*b* or a primary optical element holder 12*c* for supporting the primary optical element 11, and a secondary optical element holder 22*a* or a secondary optical element holder 22*b* or a secondary optical element holder 22*c* for supporting the secondary optical element 21.

Figure 52:
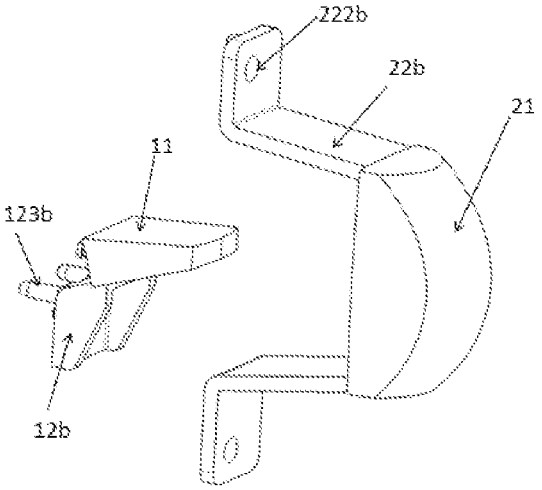
FIG. 52 is a schematic structural diagram of a high beam module in a specific embodiment of the present application.
Figure 53:
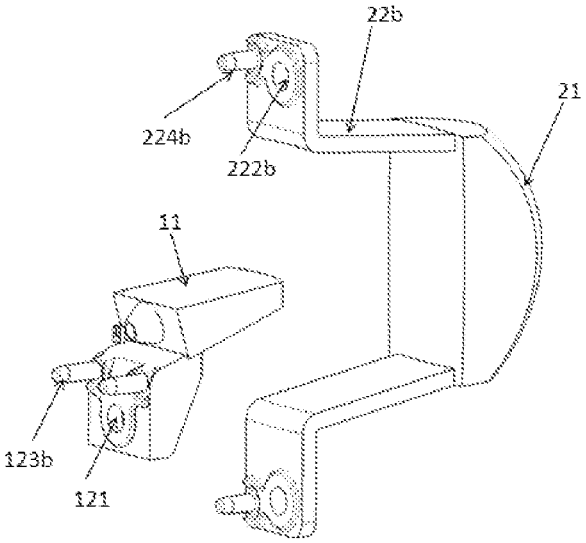
FIG. 53 is a three-dimensional diagram of a high beam module in a specific embodiment of the present application as viewed from rear.
Figure 59:
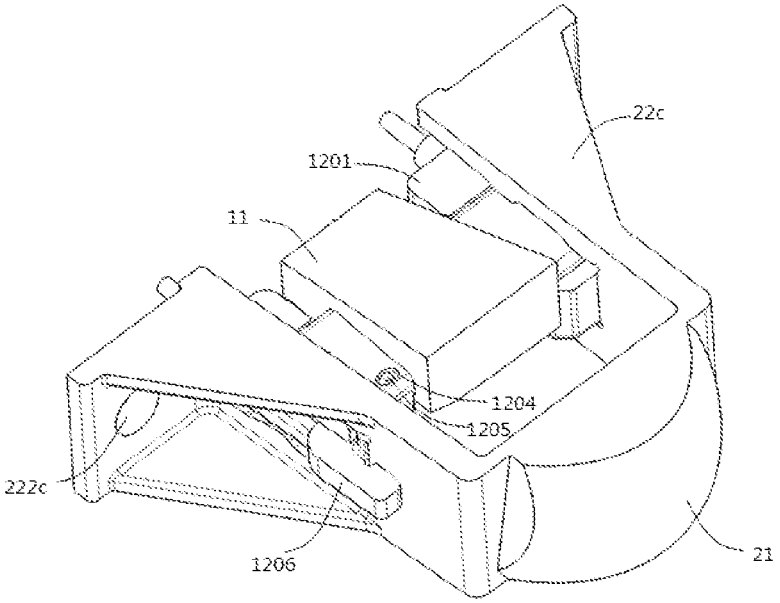
FIG. 59 is a three-dimensional structural diagram of a vehicle lamp optical element assembly in a specific embodiment of the present application.

The secondary optical element 21 and the secondary optical element holder 22*a* or the secondary optical element holder 22*b* or the secondary optical element holder 22*c* are an integrally formed part; further, the secondary optical element holder 22*a* may be used as a light-shielding hood to prevent light leakage, has both supporting and light-shielding functions in a module structure as shown in FIG. 1, and is subjected to double-shot molding with the secondary optical element 21; the secondary optical element 21 is made of a transparent material (transparent plastic, silica gel or the like), and the secondary optical element holder 22*a* is made of a dark light-shielding material (black PC or the like). The secondary optical element holder 22*b* and the secondary optical element holder 22*c* as shown in FIGS. 52 and 59 only have a supporting function.

Figure 6:
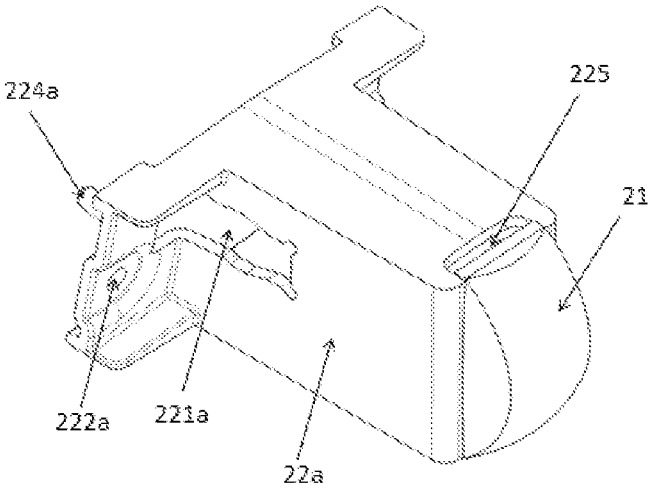
FIG. 6 is a schematic structural diagram of an embodiment of an integrated secondary optical element and secondary optical element holder of a main low beam module in a specific embodiment of the present application.
Figure 7:
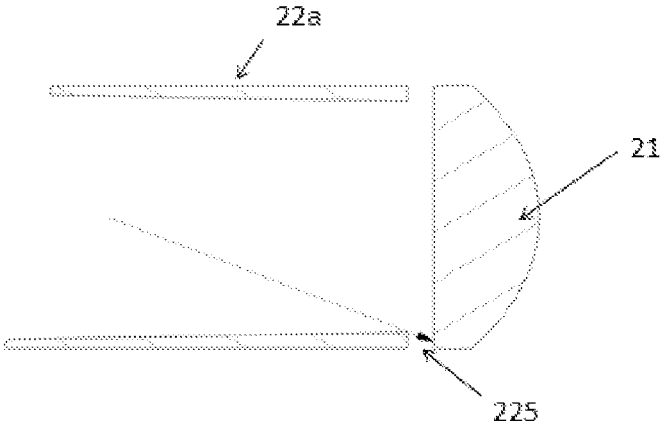
FIG. 7 is a longitudinal sectional diagram of FIG. 6.
Figure 8:
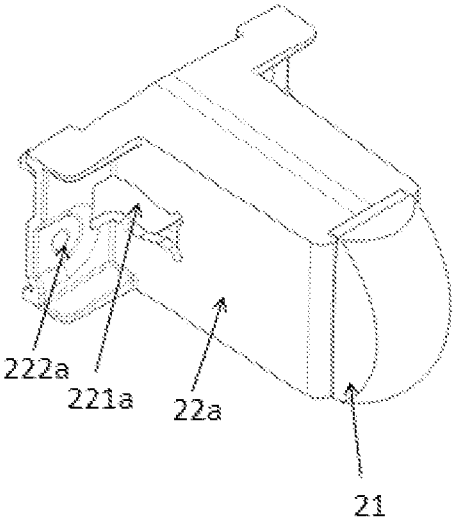
FIG. 8 is a schematic structural diagram of another embodiment of an integrated secondary optical element and secondary optical element holder of a main low beam module in a specific embodiment of the present application.
Figure 9:
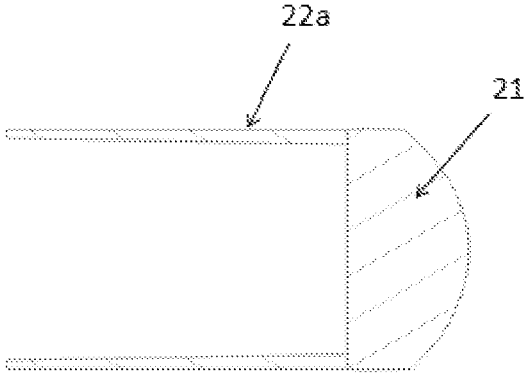
FIG. 9 is a longitudinal sectional diagram of FIG. 8.

As shown in FIGS. 6 and 7, openings 225 are formed between upper and lower ends of the secondary optical element 21 and the secondary optical element holder 22*a*. The openings 225 are used for increasing light entering the secondary optical element 21 to improve the light effect. As shown in FIGS. 8 and 9, if the openings are not provided, light irradiated to the position can be absorbed by the secondary optical element holder 22*a* with a light absorption function, and cannot enter the secondary optical element 21. Of course, the openings may be not provided.

There are at least two implementation modes for fixing relative positions of the primary optical element 11 and the secondary optical element 21 of the vehicle illumination module of the present application. In one mode, the primary optical element holder 12*a* and the secondary optical element holder 22*a* are connected in a pluggable manner, or the primary optical element holder 12*c* and the secondary optical element holder 22*c* are connected in a pluggable manner, to fix the relative positions of the primary optical element 11 and the secondary optical element 21, and the secondary optical element holder 22*a* or the secondary optical element holder 22*c* is fixedly connected to the radiator 3; and in the other mode, the primary optical element holder 12*b* and the secondary optical element holder 22*b* are both fixedly connected to the radiator 3 to fix the relative positions of the primary optical element 11 and the secondary optical element 21.

The above-mentioned two implementation modes of the vehicle illumination module are described in detail below through specific embodiments.

First Embodiment of the Vehicle Illumination Module

As shown in FIGS. 6, 8, 11 and 14, the primary optical element holder 12*a* includes insertion positioning parts 1101 formed on two sides of the primary optical element 11, and the secondary optical element holder 22*a* is provided with insertion slots 221*a* for insertion of the insertion positioning parts 1101.

Figure 20:
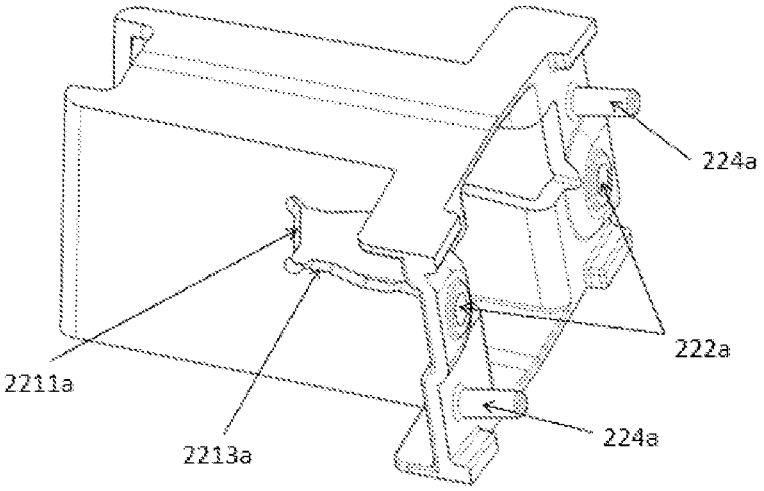
FIG. 20 is a schematic diagram of a secondary optical element holder of a main low beam module in a specific embodiment of the present application as viewed from rear.
Figure 21:
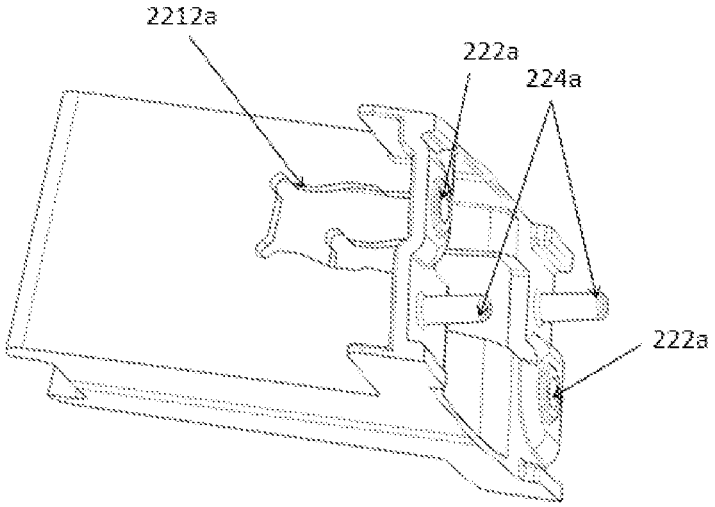
FIG. 21 is a three-dimensional diagram in another direction of FIG. 20.
Figure 22:
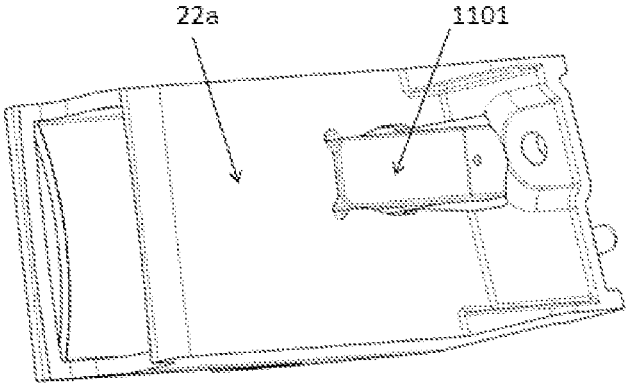
FIG. 22 is a three-dimensional diagram of a primary optical element and a secondary optical element holder of a main low beam module in a specific embodiment of the present application after cooperative fixation.
Figure 23:
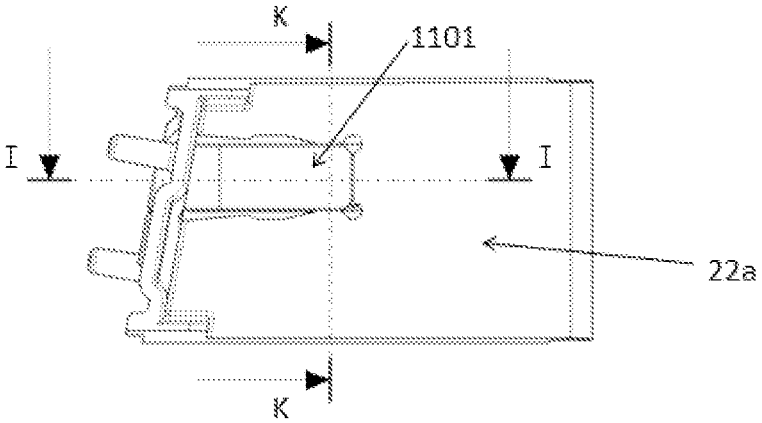
FIG. 23 is a schematic diagram of a primary optical element and a secondary optical element holder of a main low beam module in a specific embodiment of the present application after cooperative fixation as viewed from side.
Figure 24:
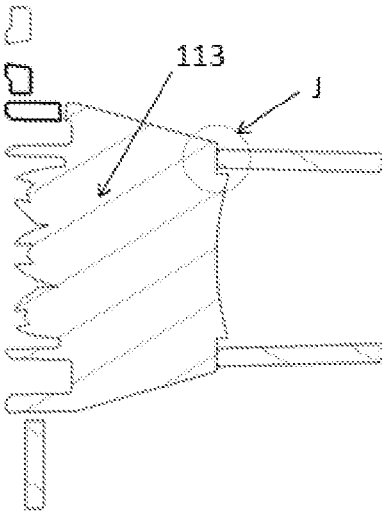
FIG. 24 is a sectional diagram in a direction I-I of FIG. 23.
Figure 25:
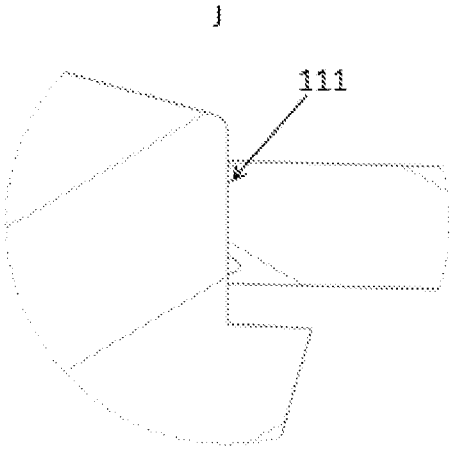
FIG. 25 is an enlarged schematic diagram of J in FIG. 24.
Figure 26:
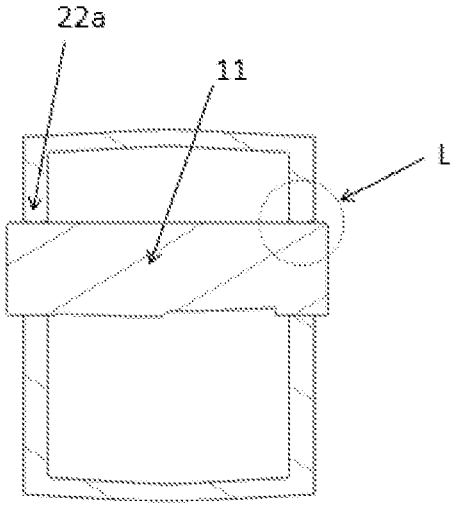
FIG. 26 is a sectional diagram in a direction K-K of FIG. 23.
Figure 27:
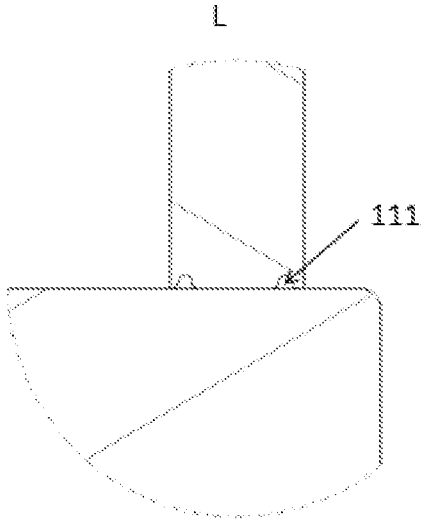
FIG. 27 is an enlarged schematic diagram of L in FIG. 26.
Figure 28:
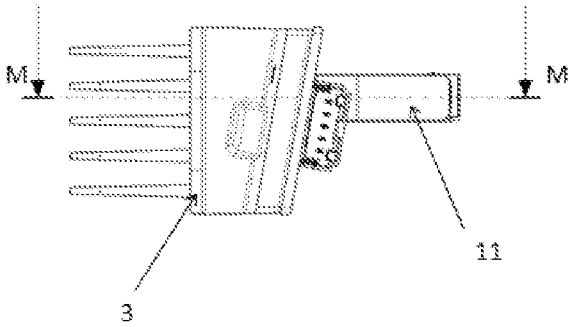
FIG. 28 is a schematic diagram of a primary optical element of a main low beam module cooperatively mounted on a circuit board and a radiator in a specific embodiment of the present application, as viewed from side.
Figure 29:
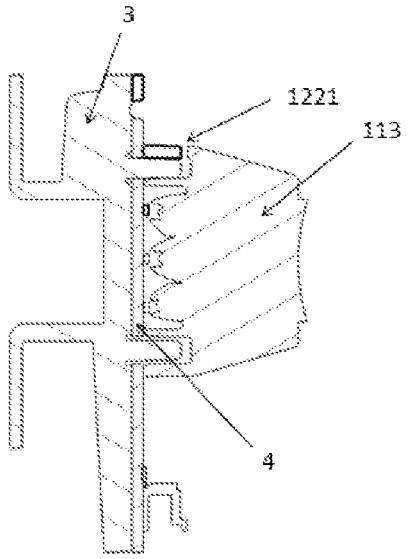
FIG. 29 is a sectional diagram in a direction M-M of FIG. 28.
Figure 30:
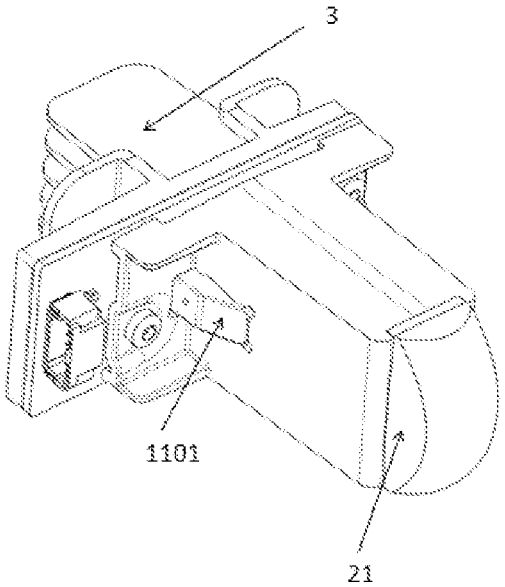
FIG. 30 is a schematic structural diagram of an auxiliary low beam module in a specific embodiment of the present application.

Specifically, the insertion slots 221*a* run through a rear end of the secondary optical element holder 22*a* and extend from rear to front, and the primary optical element 11 may be inserted forward from openings of the insertion slots 221*a* from rear. A front end surface of each insertion positioning part 1101 is in contact with a front surface 2211*a* (as shown in FIG. 20) of an inner side of the corresponding insertion slot 221*a*, and a rear end surface of each insertion positioning part 1101 is in contact with a surface of the circuit board 4, to restrict rearward and forward movement of the primary optical element 11 relative to the secondary optical element holder 22*a*; and a top surface of each insertion positioning part 1101 is in contact with an upper surface 2212*a* (as shown in FIG. 21) of an inner side of the corresponding insertion slot 221*a*, and a bottom surface of each insertion positioning part 1101 is in contact with a lower surface 2213*a* (as shown in FIG. 20) of the inner side of the corresponding insertion slot 221*a*, to restrict upward and downward movement of the primary optical element 11 relative to the secondary optical element holder 22*a*.

The material of the primary optical element 11 is transparent plastic (PC, PMMA or the like), silica gel or glass, and is preferably silica gel. When the material of the primary optical element 11 is silica gel, referring to FIGS. 13, 16-19 and 24-27, protruding structures 111 are provided on surfaces, in contact with the insertion slots 221*a*, of the insertion positioning parts 1101. By using the characteristic that the deformation of silica gel under stress is larger than that of plastic such as PC or PMMA, the primary optical element 11 of the silica gel is compressed under a contact force of the secondary optical element holder 22*a*, resulting in interference fit therebetween, thereby improving the installation reliability of the primary optical element 11.

Figure 10:
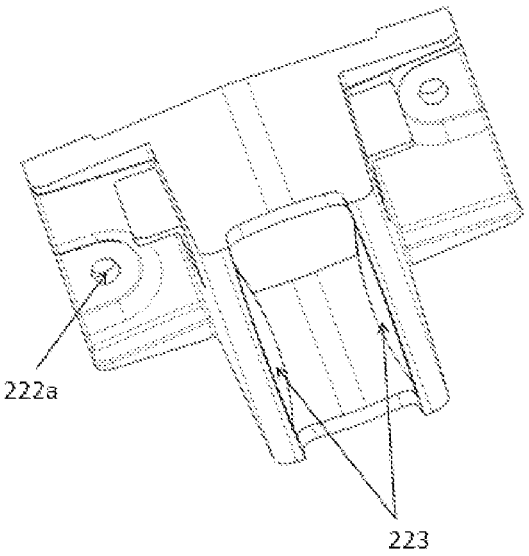
FIG. 10 is a schematic structural diagram of a secondary optical element holder of a main low beam module in a specific embodiment of the present application.
Figure 11:
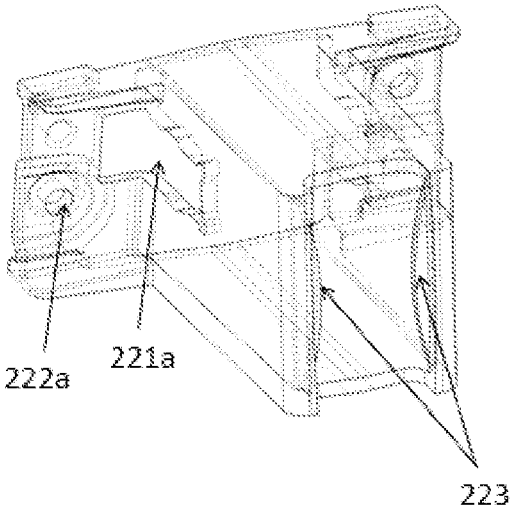
FIG. 11 is a three-dimensional diagram in another direction of FIG. 10.
Figure 12:
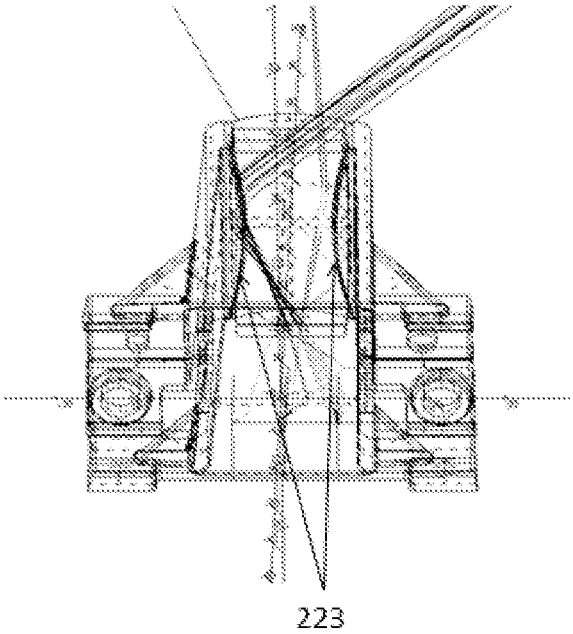
FIG. 12 is a schematic diagram of an original optical path of light shielded by arc-shaped baffles of a main low beam module in a specific embodiment of the present application.

As shown in FIGS. 10-11, arc-shaped baffles 223 are arranged at left and right inner sides of a front end of the secondary optical element holder 22*a*, and as shown in FIG. 12, the arc-shaped baffles 223 are used for shielding light that forms stray light after entering the secondary optical element 21 and being emitted, so that the stray light may be eliminated. That is to say, stray light (light outside the illuminating light shape, collectively referred to as ineffective light) may be formed if the light shielded by the arc-shaped baffles 223 enters the secondary optical element 21 and is refracted by the secondary optical element 21. The reason why the arc-shaped baffles 223 are configured in an arc shape is that incident light in the middle of the secondary optical element 21 is more than light at upper and lower ends thereof. The arc shape can achieve the effect that not only can the light that forms the stray light be shielded, but also excessive shielding of the light that forms the illuminating light shape can be avoided. That is to say, if the baffles are rectangular, too much of the incident light at the upper and lower ends of the secondary optical element 21 is shielded, including light for forming the illuminating light shape.

Figure 2:
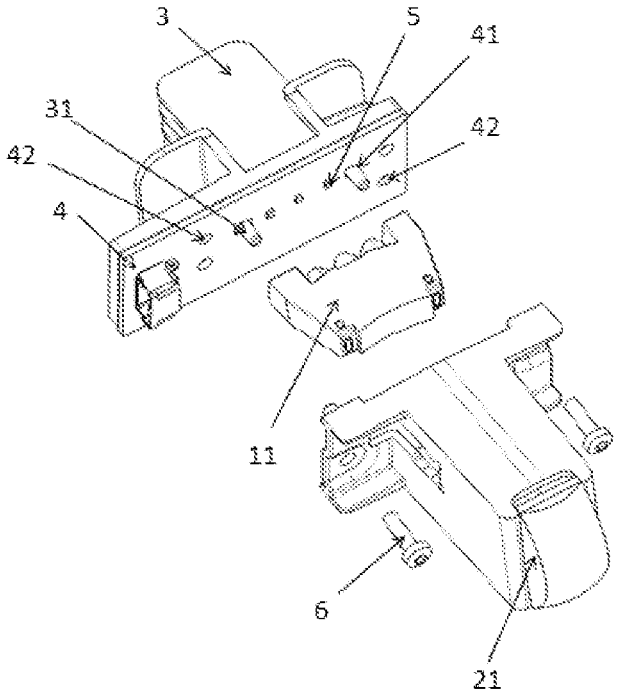
FIG. 2 is an exploded diagram of FIG. 1.

As shown in FIGS. 2 and 6, secondary optical element holder mounting holes 222*a* are formed in a rear end of the secondary optical element holder 22*a*, and correspondingly, mounting holes corresponding to the secondary optical element holder mounting holes are formed in the radiator 3 and the circuit board 4, wherein the mounting holes in the radiator 3 are threaded holes, and screws 6 pass through the secondary optical element holder mounting holes 222*a*, the mounting holes in the circuit board 4 and the mounting holes in the radiator 3 successively to mount the secondary optical element holder 22*a* on the radiator 3 and the circuit board 4.

Specifically, as shown in FIGS. 2 and 3, the radiator 3 is provided with radiator positioning pins 31, and the primary optical element 11 is provided with primary optical element positioning holes 122 cooperated with the radiator positioning pins 31; correspondingly, the circuit board 4 is provided with circuit board primary positioning holes 41, and the radiator positioning pins 31 pass through the circuit board primary positioning holes 41 and cooperate with the primary optical element positioning holes 122 to limit the primary optical element 11 on the radiator 3 and the circuit board 4; and as shown in FIGS. 2 and 6, a rear end surface of the secondary optical element holder 22*a* is provided with secondary optical element holder positioning pins 224*a*, the radiator 3 is provided with radiator secondary positioning holes, and the circuit board 4 is provided with circuit board secondary positioning holes 42, and the radiator secondary positioning holes and the circuit board secondary positioning holes 42 cooperate with the secondary optical element holder positioning pins 224*a* to limit the secondary optical element 21 on the radiator 3 and the circuit board 4.

As shown in FIGS. 3 and 13, the number of the primary optical element positioning holes 122 is preferably two, wherein one primary optical element positioning hole is a circular hole in contact with a peripheral surface of the corresponding radiator positioning pin 31, and the other primary optical element positioning hole is a slotted hole in clearance fit with the corresponding radiator positioning pin 31. If the two primary optical element positioning holes 122 are both circular holes, the radiator positioning pins 31 can be smoothly inserted into the primary optical element positioning holes 122 only by the excessively accurate positioning of the radiator positioning pins 31, which increases the processing difficulty and easily causes over positioning. Therefore, one of the primary optical element positioning holes 122 is configured as the slotted hole, such that as long as one of the radiator positioning pins 31 is aligned to the circular hole, the other radiator positioning pin 31 can be easily inserted into the slotted hole, and the positioning accuracy is not reduced. The primary optical element 11 is provided with a vent hole 1221 that communicates the circular hole with the outside to prevent the problem that air compression is caused after the radiator positioning pin 31 is inserted into the circular hole to result in deformation of the primary optical element 11 so as to affect the accuracy of an optical system and further affect a light shape effect.

A dimension of a light emergent surface of the secondary optical element 21 in at least one of an up-down direction and a left-right direction is smaller than or equal to 35 mm, preferably smaller than or equal to 15 mm, to meet the requirement of a small opening of the secondary optical element 21. The secondary optical element 21 is preferably a lens.

The vehicle illumination module of the embodiment may be a main low beam module, an auxiliary low beam module, a main high beam module, or an auxiliary high beam module. The difference lies in that vehicle lamp optical element assemblies of different structures are selected according to respective light shape requirements, and corresponding light distribution is performed.

Main Low Beam Module

Figure 15:
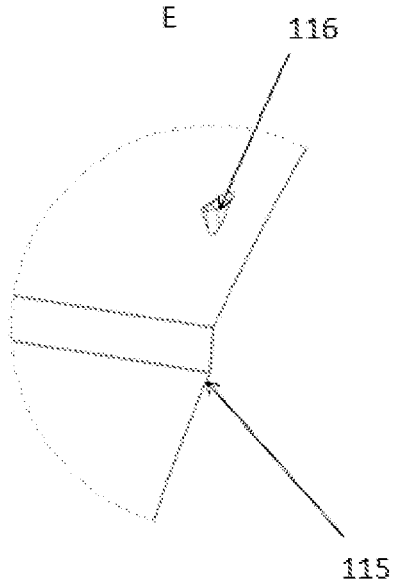
FIG. 15 is an enlarged schematic diagram of E in FIG. 14.

As shown in FIGS. 14 and 15, a cutoff part 115 is arranged at a lower boundary of a light exit part 114 of the main low beam module, and a shape of the cutoff part 115 is matched with a shape of a low beam light-dark cutoff line.

Figure 16:
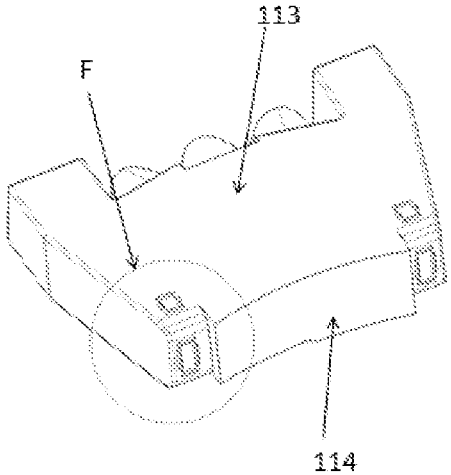
FIG. 16 is a three-dimensional diagram of an integrated part of a primary optical element and a primary optical element holder of a main low beam module in a specific embodiment of the present application as viewed from upper front.
Figure 17:
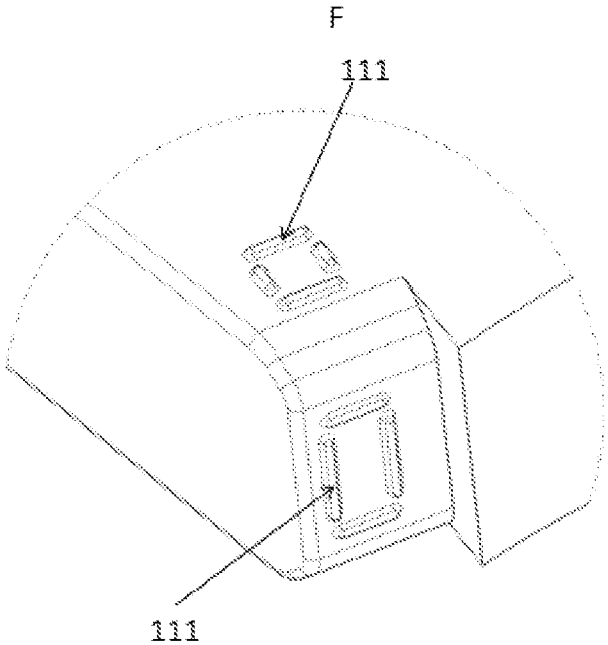
FIG. 17 is an enlarged schematic diagram of F in FIG. 16.

As shown in FIG. 16, the light exit part 114 of the main low beam module is a concave arc surface, which is adapted for a focal plane of a secondary optical element 21, so that a light shape in a light shape central area is clear.

As shown in FIGS. 14-15, a position, close to the light exit part 114, of a lower surface of a primary optical element 11 of the main low beam module is provided with a recessed part 116 which is upwardly recessed and used for forming a light shape of a 50 L dark area and for changing an optical path of part of light to achieve a function that the brightness of the 50 L dark area is reduced, that is, a light transmission direction of light which originally irradiates to the position is changed due to the presence of the recessed part 116, and the light does not irradiate to the 50 L dark area, so that the brightness of the 50 L dark area meets a regulatory requirement.

A focal length of the secondary optical element 21 of the main low beam module is 10-30 mm, preferably 15 mm, 20 mm, 25 mm, or 30 mm.

An overall dimension of the main low beam module is: 70-120 mm in a front-rear direction (length), 50-80 mm in a left-right direction (width), and 20-40 mm in an up-down direction (height).

To ensure that in the case where a left-right width of the secondary optical element 21 is small, the light emergent the primary optical element 11 enters the secondary optical element 21 as much as possible, and meanwhile high brightness in the light shape central area can be achieved, optical axes of the light entrance parts 112 on two sides of the main low beam module are inclined toward a direction getting closer to the optical axis 211 of the secondary optical element, so that the light is concentrated toward the middle, to ensure that the light from the primary optical element 11 can substantially enter the secondary optical element 21.

Figure 5:
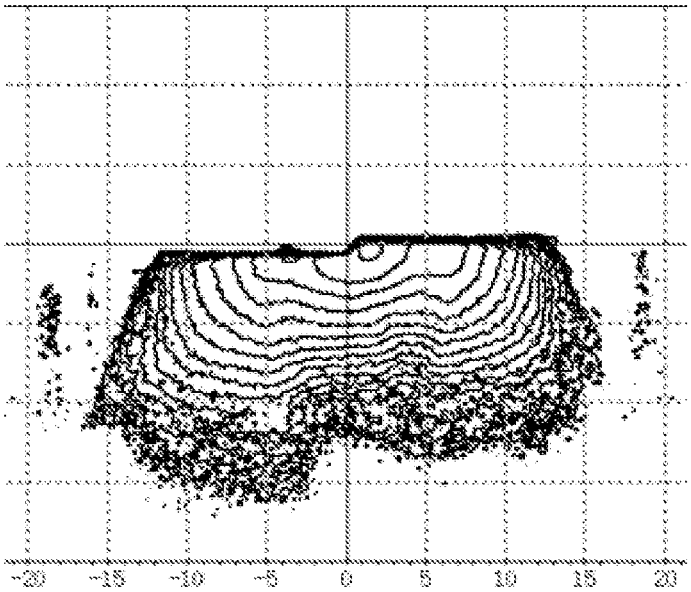
FIG. 5 is a schematic diagram of a light shape formed by projection of a main low beam module in a specific embodiment of the present application.

A light shape formed by projection of the above-mentioned main low beam module is shown in FIG. 5.

Auxiliary Low Beam Module

Referring to FIGS. 30-39, an installation structure of the auxiliary low beam module is the same as that of the above-mentioned main low beam module. The difference lies in that a widening angle of a light shape formed by projection of the auxiliary low beam module is very large. To form a light shape of a low beam widening area with a very large widening angle, optical surfaces of a primary optical element 11 and a secondary optical element 21 need to cooperate with each other, and light distribution is performed therebetween to obtain a light shape with a suitable widening angle. An embodiment is described below.

Figure 37:
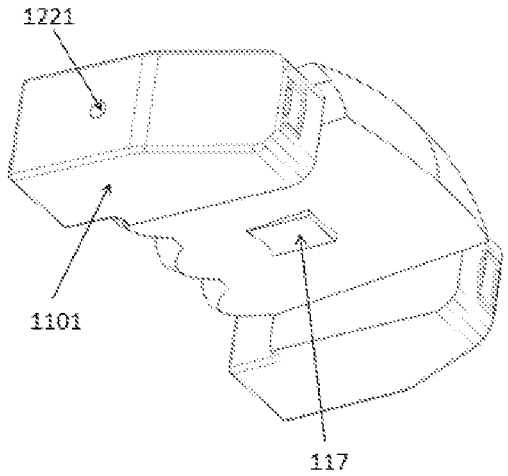
FIG. 37 is a three-dimensional diagram of a primary optical element of an auxiliary low beam module in a specific embodiment of the present application as viewed from bottom.
Figure 38:
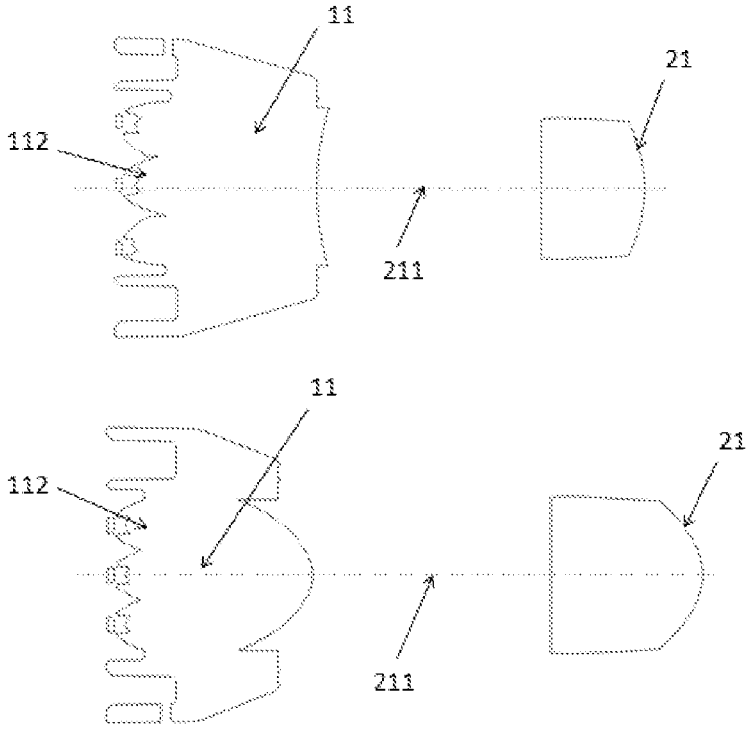
FIG. 38 is a transverse section comparison diagram of primary optical elements and secondary optical elements of a main low beam module and an auxiliary low beam module in a specific embodiment of the present application.

In the primary optical element 11 of the above-mentioned main low beam module, to ensure that in the case where the left-right width of the secondary optical element 21 is small, the light emergent from the primary optical element 11 enters the secondary optical element 21 as much as possible, and meanwhile high brightness in the light shape central area is achieved, the optical axes of the light entrance parts 112 on two sides in an upper diagram of FIG. 38 are arranged to be inclined with respect to the optical axis 211 of the secondary optical element, and inclined toward a directions getting closer to the optical axis 211 of the secondary optical element, so that the light is concentrated toward the middle, to ensure that the light from the primary optical element 11 can substantially enter the secondary optical element 21. Since light sources 5 are arranged on the same circuit board 4, there is a certain angle between an optical axis of each light source 5 and the optical axis of each of the light entrance parts 112 on two sides, resulting in insufficient light effect. Therefore, to achieve that the light effect is not lost under the circumstance that the secondary optical element 21 has a smaller width, as shown in a lower diagram in FIG. 38, all light entrance parts 112 of the auxiliary low beam module are configured to have an optical axis direction same as the direction of an optical axis 211 of the secondary optical element, and a transverse section line of a light exit part 114 of the primary optical element 11 is configured as a forward protruding arc, so that the emergent light is concentrated toward the middle, to achieve that the light can substantially enter the secondary optical element 21 with a small width. Similarly, as shown in FIG. 39, a longitudinal section line of the light exit part 114 of the primary optical element 11 is also configured as a forward protruding arc, so that the emergent light in the direction is concentrated toward the middle, and the height of the secondary optical element 21 may be small. As shown in FIGS. 33-39, the longitudinal section line of the auxiliary low beam module is gradually curved upward and rearward from a lower boundary of the light exit part 114 of the primary optical element 11, and a focal point of the secondary optical element 21 is preferably set on the lower boundary, and a lower surface of the primary optical element 11 is inclined rearward and downward with respect to the optical axis 211 of the secondary optical element, with an inclination angle of less than or equal to 15°, preferably 5°-10°, which further allows more emergent light to enter the secondary optical element 21 and improves the light effect.

A radius of any point on the light exit part 114 of the primary optical element 11 of the auxiliary low beam module is 5-150 mm, preferably 7-25 mm, and a specific value is determined according to actual light distribution.

As shown in FIGS. 38-39 (in FIG. 38, an upper diagram is a transverse sectional diagram of the main low beam module, and a lower diagram is a transverse sectional diagram of the auxiliary low beam module; and in FIG. 39, an upper diagram is a longitudinal sectional diagram of the main low beam module, and a lower diagram is a longitudinal sectional diagram of the auxiliary low beam module), to achieve a light shape of a low beam widening area with a large widening angle, the protruding degree of the light emergent surface of the secondary optical element 21 of the auxiliary low beam module is greater than that of the light emergent surface of the secondary optical element 21 of the main low beam module, so that light entering the lens can be refracted at a greater angle to obtain a larger widening angle.

Figure 34:
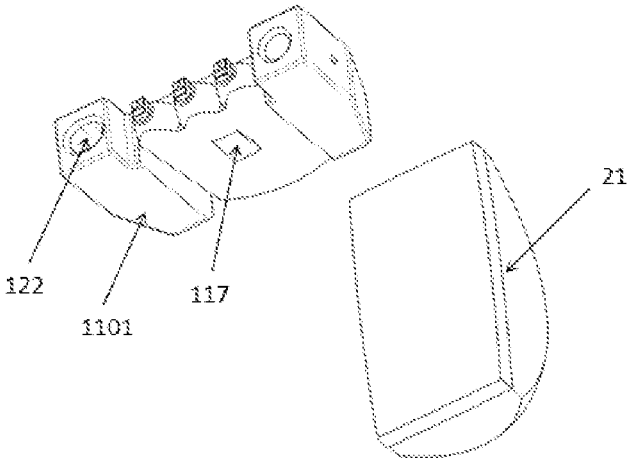
FIG. 34 is a three-dimensional diagram of FIG. 33 as viewed from rear bottom.
Figure 35:
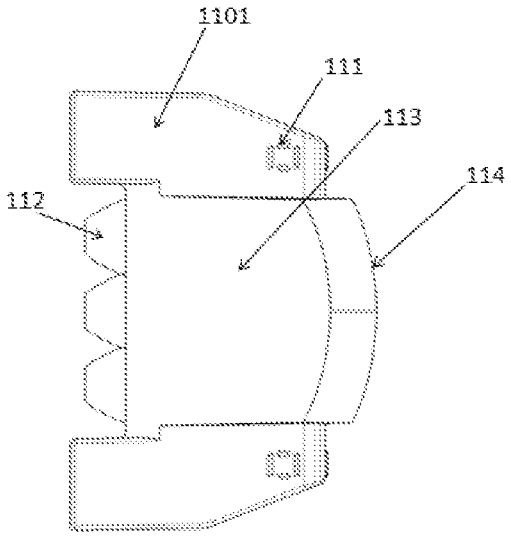
FIG. 35 is a top view of a primary optical element of auxiliary low beam module in a specific embodiment of the present application.
Figure 36:
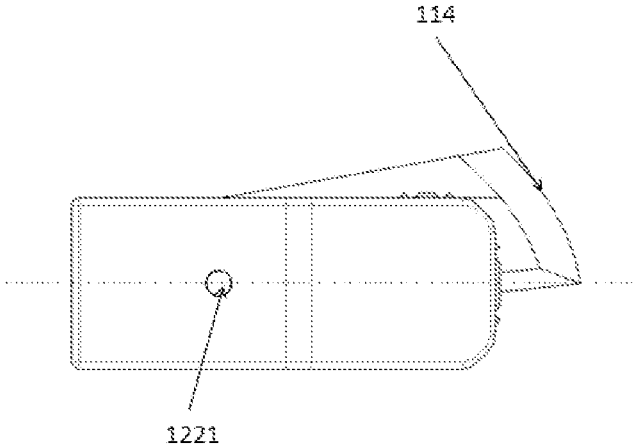
FIG. 36 is a side view of a primary optical element of an auxiliary low beam module in a specific embodiment of the present application.

As the secondary optical element 21 of the auxiliary low beam module enables the module to form a light shape with a large widening angle, as shown in FIGS. 34 and 37, the lower surface of the primary optical element 11 of the auxiliary low beam module may be provided with a zone III structure 117 for forming a low beam zone III light shape, and the zone III structure 117 cooperates with the secondary optical element 21 to form the low beam zone III light shape with a larger width. The zone III structure 117 is provided in a middle segment of the light transmission part 113, and has a wedge-shaped structure and a thickness gradually increasing from rear to front.

A light emergent surface of the zone III structure 117 is a flat surface or a curved surface, has a width of 2-5 mm in the left-right direction, preferably 3 mm, and a height of 0.2-1 mm in the up-down direction, preferably 0.4 mm.

As the auxiliary low beam module is used for forming a low beam widening light shape, the shape of the lower boundary of the primary optical element 11 of the auxiliary low beam module does not need to be matched with the shape of a low beam light-dark cutoff line.

The primary optical elements 11 of the main low beam module and the auxiliary low beam module may also be used interchangeably, so long as parameters of the optical surfaces are adjusted by light distribution to meet a desired light shape.

Figure 40:
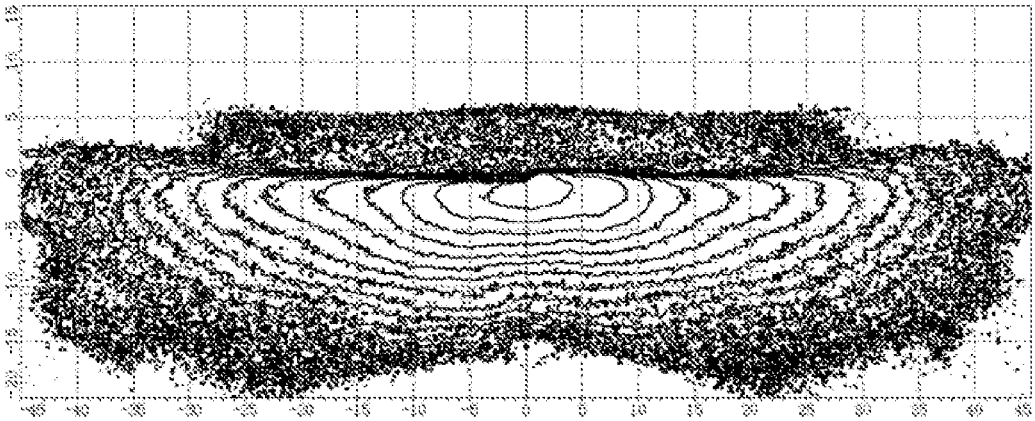
FIG. 40 is a schematic diagram of a light shape formed by projection of an auxiliary low beam module with a zone III structure in a specific embodiment of the present application.
Figure 41:
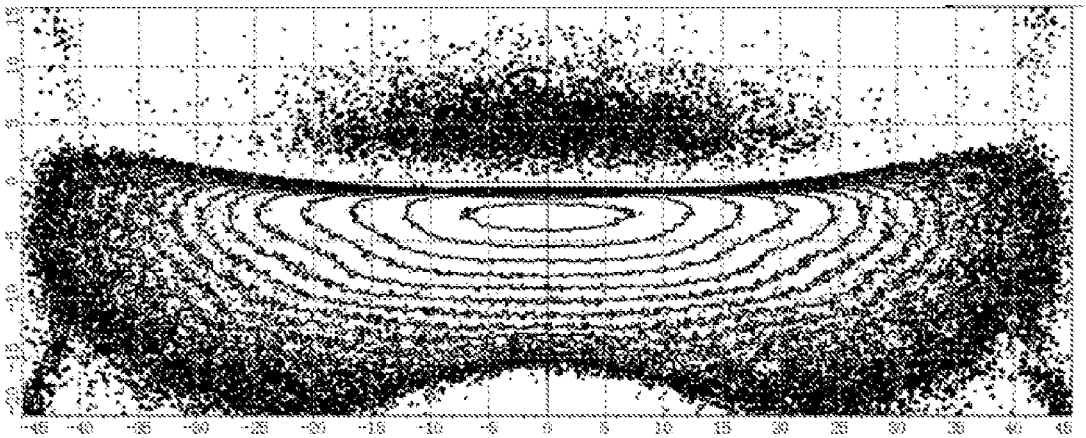
FIG. 41 is a schematic diagram of a light shape formed by projection of an auxiliary low beam module without a zone III structure in a specific embodiment of the present application.
Figure 42:
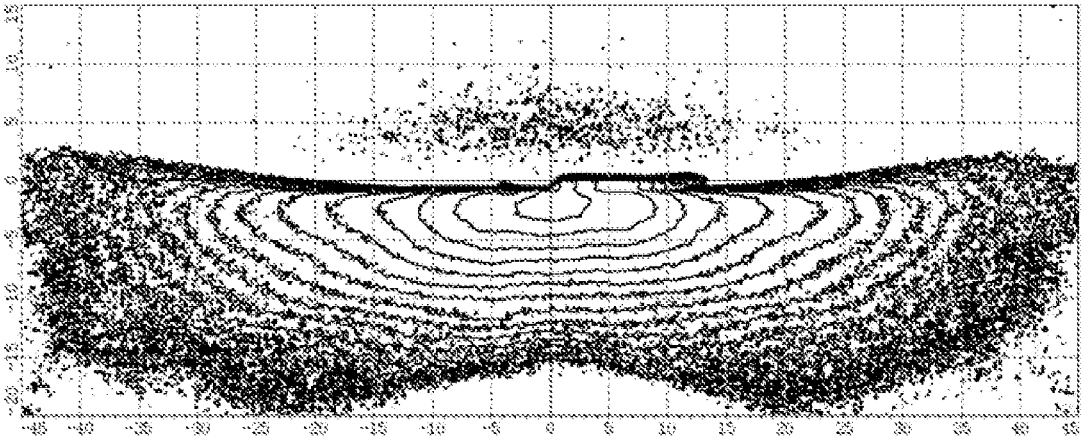
FIG. 42 is a schematic diagram of a light shape formed by projection by superposed main low beam module and auxiliary low beam module without a zone III structure in a specific embodiment of the present application.
Figure 43:
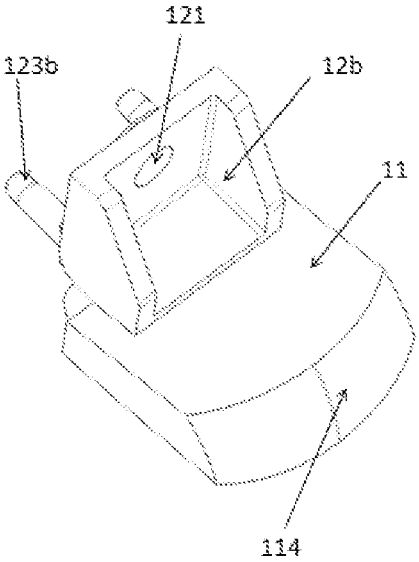
FIG. 43 is a schematic structural diagram of a primary optical element and a primary optical element holder of a low beam module in a specific embodiment of the present application.
Figure 44:
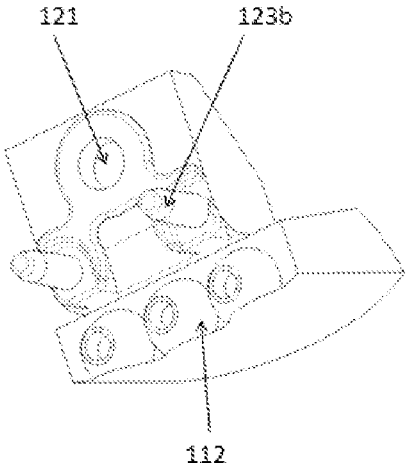
FIG. 44 is a three-dimensional diagram of FIG. 43 as viewed from rear.
Figure 45:
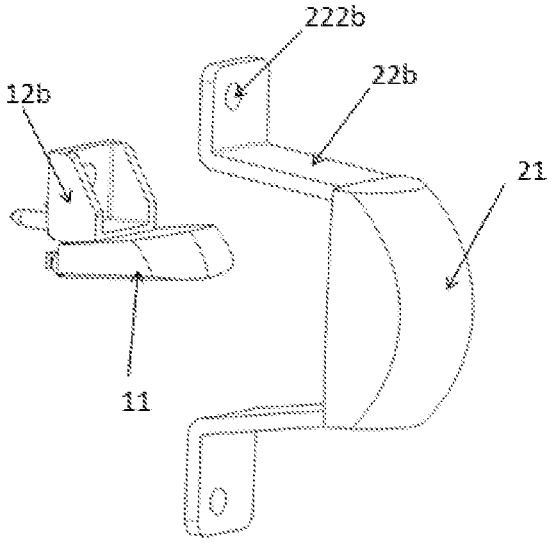
FIG. 45 is a schematic structural diagram of a low beam module in a specific embodiment of the present application.
Figure 46:
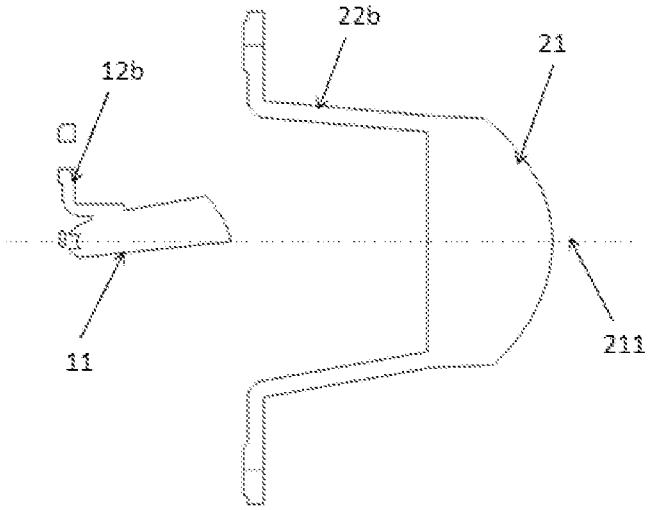
FIG. 46 is a longitudinal sectional diagram of a low beam module in a specific embodiment of the present application.
Figure 47:
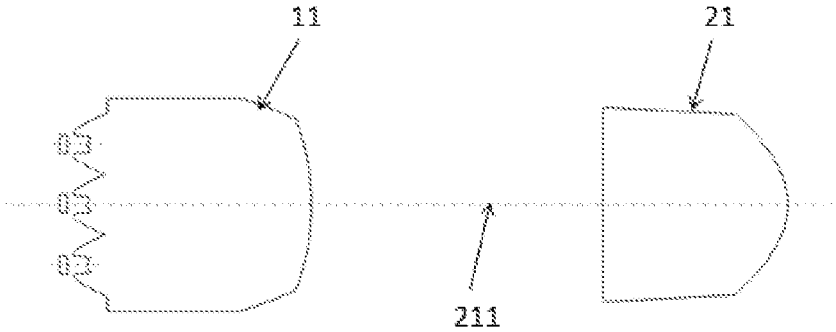
FIG. 47 is an orientation diagram of a primary optical element and a secondary optical element of a low beam module in a specific embodiment of the present application.
Figure 48:
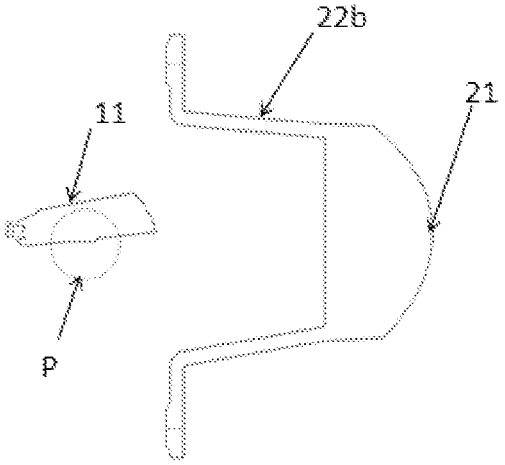
FIG. 48 is an orientation diagram of a primary optical element, a secondary optical element and a secondary optical element holder of a low beam module in a specific embodiment of the present application.
Figure 49:
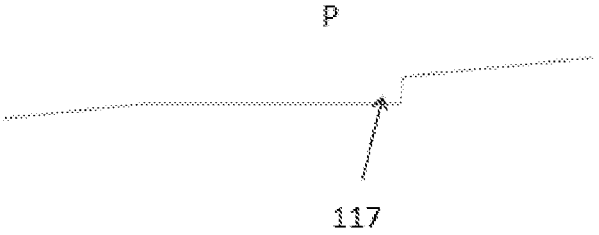
FIG. 49 is an enlarged schematic diagram of P in FIG. 48.

A light shape formed by projection of an auxiliary low beam module with the zone III structure 117 is as shown in FIG. 40; a light shape formed by projection of an auxiliary low beam module without the zone III structure 117 is as shown in FIG. 41; and a light shape formed by projection of superposed auxiliary low beam module without the zone III structure 117 and a main low beam module is as shown in FIG. 42.

The differences between a main high beam module and an auxiliary high beam module, and the above-mentioned main low beam module are conventional distinguishing structures according to high beam characteristics in the prior art, and will not be enumerated herein.

Second Embodiment of the Vehicle Illumination Module

Referring to FIGS. 59-68, the primary optical element holder 12*c* includes a support frame 1201 and limiting pieces 1202, wherein the limiting pieces 1202 are fixedly arranged on the primary optical element 11; the support frame 1201 is provided with limiting slots 1203; the limiting pieces 1202 are cooperatively connected with the limiting slots 1203 and are fixed relative to the support frame 1201; and through the cooperative connection between the limiting pieces 1202 and the support frame 1201, the primary optical element 11 is fixed relative to the support frame 1201, so that the primary optical element 11 is positioned and supported on the primary optical element holder 12*c*, that is, the limiting pieces 1202 and the support frame 1201 are assembled together to form the primary optical element holder 12*c* that supports the primary optical element 11. In a preferred embodiment, an upper surface of the support frame 1201 is partially sunk to form the limiting slots 1203, so that bottom surfaces of the limiting slots 1203 face upward and are horizontal surfaces, and lower surfaces of the limiting pieces 1202 are horizontal surfaces, the limiting pieces 1202 are placed in the limiting slots 1203, and the lower surfaces of the limiting pieces 1202 are in contact and cooperation with the bottom surfaces of the limiting slots 1203.

To increase the accuracy of assembly positioning between the limiting pieces 1202 and the support frame 1201, limiting piece positioning holes 1204 are formed in the limiting pieces 1202, and primary optical element holder positioning pins 1205 in cooperation with the limiting piece positioning holes 1204 in a pluggable manner are arranged in the limiting slots 1203. When the limiting pieces 1202 are mounted on the support frame 1201, through the pluggable cooperation between the primary optical element holder positioning pins 1205 and the limiting piece positioning holes 1204, relative positions of the limiting pieces 1202 and the support frame 1201 can be limited, and the limiting pieces 1202 are positioned accurately, thereby achieving accurate positioning between the primary optical element 11 and the primary optical element holder 12*c*.

Referring to FIGS. 59, 60, 65 and 66, the secondary optical element holder 22*c* is provided with insertion slots 221*c*, and the primary optical element holder 12*c* is in cooperation with the insertion slots 221*c* in a pluggable manner, and the primary optical element holder 12*c* has positioning surfaces in contact with surfaces of inner sides of the insertion slots 221*c*. Through contact and cooperation between the positioning surfaces of the primary optical element holder 12*c* and the surfaces of the inner sides of the insertion slots 221*c*, relative positions of the primary optical element holder 12*c* and the secondary optical element holder 22*c* may be limited, so that the primary optical element holder 12*c* and the secondary optical element holder 22*c* are relatively fixed, thereby achieving assembly positioning between the primary optical element holder 12*c* and the secondary optical element holder 22*c*, and the advantages of convenient installation and reliable positioning.

Each of the left and right sides of the primary optical element 11 is provided with one limiting piece 1202, and correspondingly, each of the left and right sides of the secondary optical element holder 22*c* is provided with one insertion slot 221*c*, and an assembly space for insertion of the primary optical element 11 is formed between the two insertion slots 221*c*. After being respectively assembled into the corresponding limiting slots 1203 in the support frame 1201, the two limiting pieces 1202, together with the support frame 1201 as a whole, are inserted into the corresponding insertion slots 221*c*, thereby achieving assembly of the primary optical element holder 12*c* and the secondary optical element holder 22*c*, with the primary optical element 11 located in the assembly space between the two insertion slots 221*c*.

Figure 61:
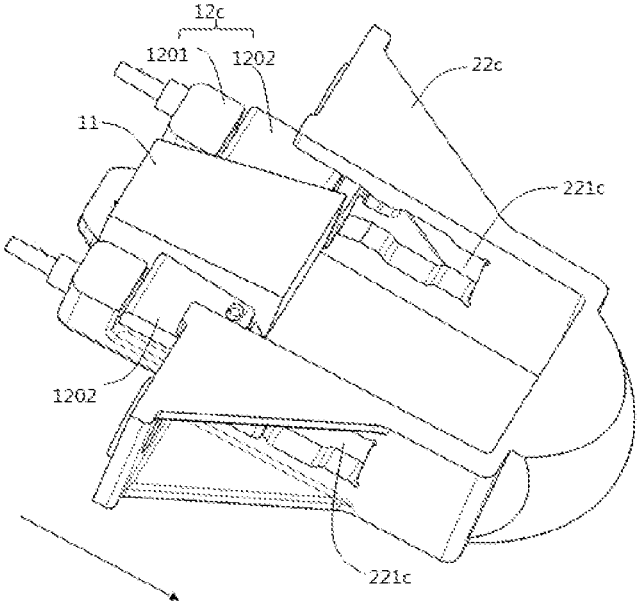
FIG. 61 is an assembly process diagram of the vehicle lamp optical element assembly in FIG. 59.

To facilitate the assembly of the primary optical element holder 12*c* and the secondary optical element holder 22*c*, and achieve that the secondary optical element 21 is located in front of the primary optical element 11, preferably, the secondary optical element 21 is arranged at a front end of the secondary optical element holder 22*c*, and the insertion slots 221*c* run through a rear end of the secondary optical element holder 22*c* and extend from rear to front, so that the primary optical element holder 12*c* can be inserted into the insertion slots 221*c* from rear ends of the insertion slots 221*c* and forwardly enter the insertion slots 221*c* in a direction indicated by a straight arrow in FIG. 61 until positioning surfaces of the primary optical element holder 12*c* are properly in contact and cooperation with the surfaces of the inner sides of the insertion slots 221*c*, with the primary optical element 11 supported on the primary optical element holder 12*c* being behind the secondary optical element 21.

Figure 60:
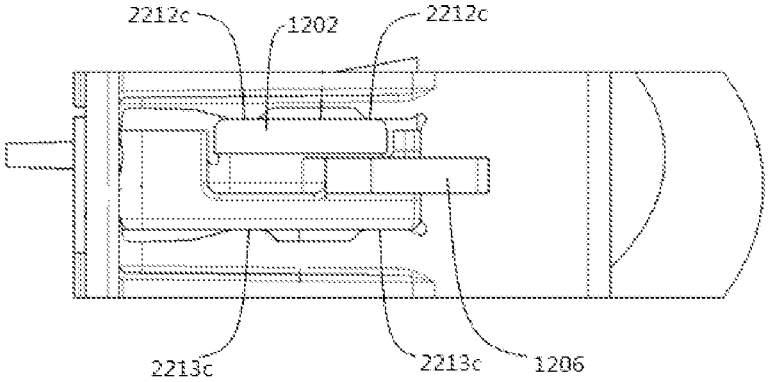
FIG. 60 is a side view of FIG. 59.

As the insertion slots 221*c* run through the rear end of the secondary optical element holder 22*c* and extend from rear to front, to ensure that the contact and cooperation between the positioning surfaces of the primary optical element holder 12*c* and the surfaces of the inner sides of the insertion slots 221*c* can effectively limit the relative positions of the primary optical element holder 12*c* and the secondary optical element holder 22*c*, a front end surface of the support frame 1201 is in contact with front surfaces 2211*c* of the inner sides of the insertion slots 221*c*, and a rear end surface of the support frame 1201 is in contact with a surface of the circuit board 4, to restrict forward movement of the primary optical element holder 12*c* relative to the secondary optical element holder 22*c*; top surfaces of the limiting pieces 1202 are in contact with upper surfaces 2212*c* of the inner sides of the insertion slots 221*c*, to restrict upward movement of the primary optical element holder 12*c* relative to the secondary optical element holder 22*c*; and a bottom surface of the support frame 1201 is in contact with lower surfaces 2213*c* of the inner sides of the insertion slots 221*c*, to restrict downward movement of the primary optical element holder 12*c* relative to the secondary optical element holder 22*c*. In the embodiment, the front end surface of the support frame 1201 located directly in front of the limiting slots 1203 constitutes a front positioning surface of the primary optical element holder 12*c*; after the limiting pieces 1202 are assembled into the limiting slots 1203 in the support frame 1201, the top surfaces of the limiting pieces 1202 are higher than the top surface of the support frame 1201, so that the top surfaces of the limiting pieces 1202 constitute an upper positioning surface of the primary optical element holder 12*c*; and the bottom surface of the support frame 1201 constitutes a lower positioning surface of the primary optical element holder 12*c*. Referring to FIG. 60, in a preferred embodiment, the upper surfaces of the inner sides of the insertion slots 221*c* are partially recessed and not in contact and cooperation with the upper surfaces of the limiting pieces 1202, and the lower surfaces of the inner sides of the insertion slots 221*c* are partially recessed and not in contact and cooperation with the lower surface of the support frame 1201, so that contact areas between the upper surfaces of the inner sides of the insertion slots 221*c* and the upper surfaces of the limiting pieces 1202 and between the lower surfaces of the inner sides of the insertion slots 221*c* and the lower surface of the support frame 1201 can be reduced to achieve small-area contact positioning. As the processing accuracy of a small-area contact surface is easier to ensure, the positioning surfaces of the primary optical element holder 12*c* and the surfaces of the inner sides of the insertion slots 221*c* can be in better contact, thereby achieving more accurate positioning.

Figure 66:
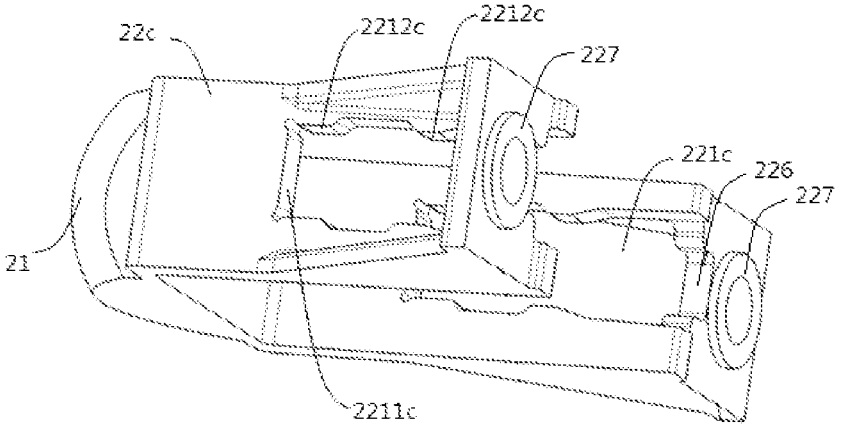
FIG. 66 is a schematic structural diagram of an integral part of a secondary optical element and a secondary optical element holder in FIG. 59 as viewed from another angle.
Figure 67:
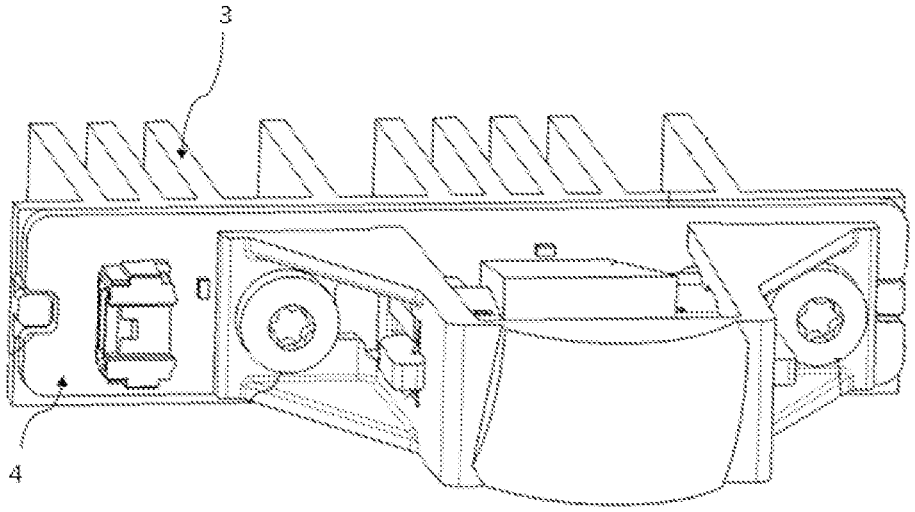
FIG. 67 is a three-dimensional schematic structural diagram of the vehicle lamp optical element assembly in FIG. 59 mounted on a circuit board and a radiator.

Further, the insertion slots 221*c* run through the secondary optical element holder 22*c* in the left-right direction, and the secondary optical element holder 22*c* is provided or integrally formed on the left and right sides of the secondary optical element 21. Two clamping part 1206 are respectively arranged at the left and right sides of the support frame 1201 respectively, and opposite inner side surfaces of the two clamping parts 1206 are respectively in contact with left and right side surfaces of the secondary optical element holder 22*c* to restrict left-right movement of the primary optical element holder 12*c* relative to the secondary optical element holder 22*c*. In a preferred embodiment, the two clamping parts 1206 are respectively arranged on the left and right side surfaces of the support frame 1201 and both extend forward to the part in front of the front end surface of the support frame 1201. After assembly, the front end surface of the support frame 1201 is in contact with the front surfaces of the inner sides of the insertion slots 221*c*, and the two clamping parts 1206 are located on the outer sides of the secondary optical element holder 22*c*, and the inner side surfaces of the two clamping parts 1206 are respectively in contact and cooperation with areas, in front of the insertion slots 221*c*, of a left side surface and a right side surface of the secondary optical element holder 22*c*. To enable the clamping parts 1206 of the primary optical element holder 12*c* to reach the outer sides in front of the insertion slots 221*c* through the rear ends of the insertion slots 221*c*, as shown in FIG. 66, the rear end of the secondary optical element holder 22*c* is provided with through slots 226 that run through the secondary optical element holder 22*c* in the front-rear direction, and openings of the through slots 226 face the insertion slots 221*c*, and communicate with the rear ends of the insertion slots 221*c* at the outer sides of the insertion slots 221*c*. When the support frame 1201 and the limiting pieces 1202 are inserted into the insertion slots 221*c*, the clamping parts 1206 on the side surfaces of the support frame 1201 pass through the through slots 226 and reach the outer sides in front of the insertion slots 221*c*.

Figure 62:
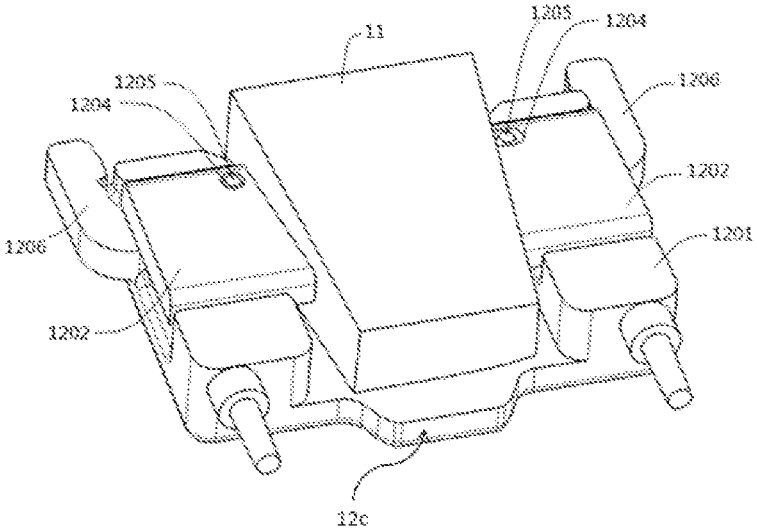
FIG. 62 is a schematic structural diagram of a primary optical element and a primary optical element holder in FIG. 59 as viewed from another angle.
Figure 63:
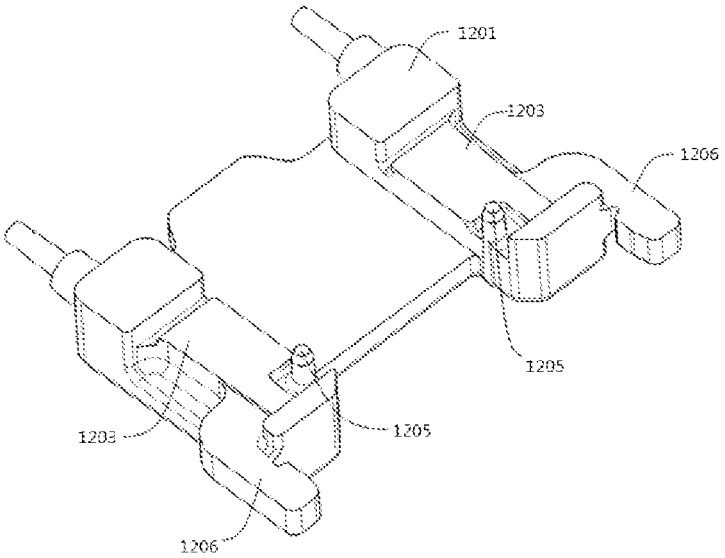
FIG. 63 is a schematic structural diagram of a support frame in FIG. 59.
Figure 64:
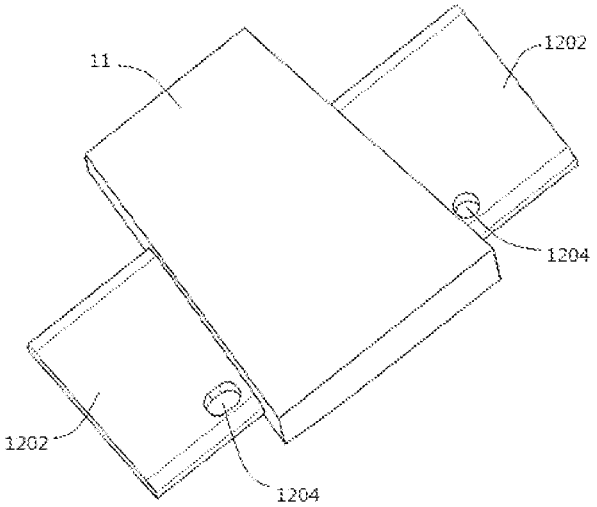
FIG. 64 is a schematic structural diagram of a primary optical element and limiting pieces in FIG. 59.
Figure 65:
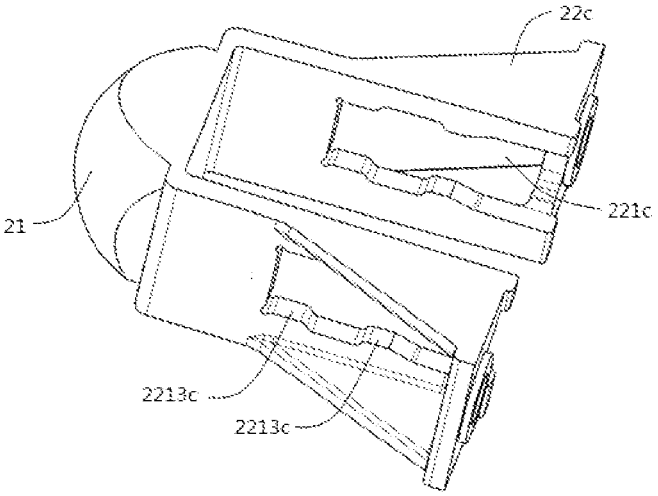
FIG. 65 is a schematic structural diagram of an integral part of a secondary optical element and a secondary optical element holder in FIG. 59 as viewed from one angle.
Figure 68:
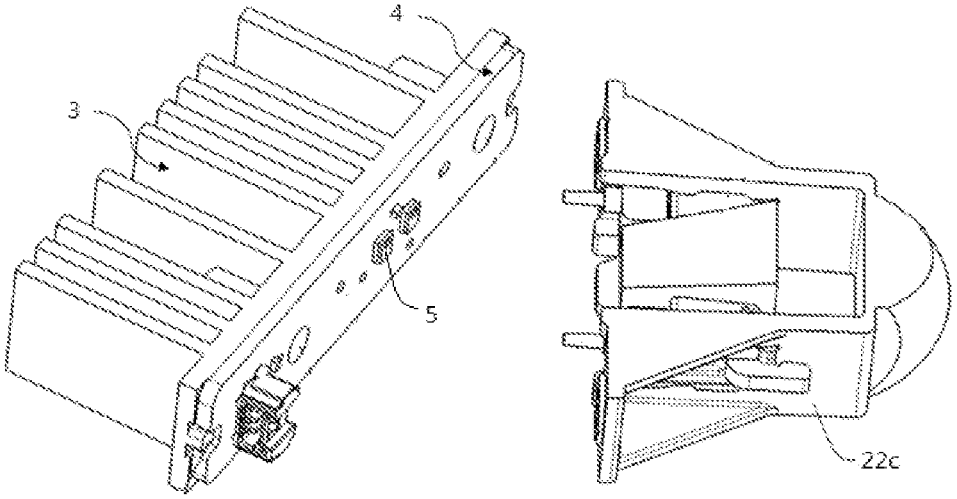
FIG. 68 is an exploded diagram of FIG. 67.

Referring to FIGS. 62, 66 and 68, preferably, the rear end of the primary optical element holder 12*c* has a rear positioning surface in contact with the surface of the circuit board 4, and a rear end surface of the secondary optical element holder 22*c* is provided with protruding parts 227 in contact with the surface of the circuit board 4. When the vehicle lamp optical element assembly is mounted on the circuit board 4, the rear positioning surface of the primary optical element holder 12*c* is in contact and cooperation with the surface of the circuit board 4, and the protruding parts 227 at the rear end of the secondary optical element holder 22*c* are in contact and cooperation with the surface of the circuit board 4, so that backward movement of the primary optical element holder 12*c* relative to the secondary optical element holder 22*c* can be restricted, and the vehicle lamp optical element assembly is positioned on the surface of the circuit board 4. The rear end surface of the support frame 1201 constitutes the rear positioning surface of the primary optical element holder 12*c*. Preferably, the protruding parts 227 may be arranged at the left and right sides of the rear end surface of the secondary optical element holder 22*c* respectively. As the protruding parts 227 in contact with the surface of the circuit board 4 are arranged on the rear end surface of the secondary optical element holder 22*c*, contact between the entire rear end surface of the secondary optical element holder 22*c* and the surface of the circuit board 4 is avoided, and the contact area between the rear end of the secondary optical element holder 22*c* and the surface of the circuit board 4 is reduced to achieve small-area contact positioning. As the processing accuracy of a small-area contact surface is easier to ensure, the protruding parts 227 and the surface of the circuit board 4 can be in better contact, thereby achieving more accurate positioning.

In summary, in the vehicle lamp optical element assembly of the embodiment, through the cooperative connection between the primary optical element holder 12*c* and the secondary optical element holder 22*c*, the primary optical element 11 and the secondary optical element 21 are assembled into an integral structure, thereby directly determining the relative positions of the primary optical element 11 and the secondary optical element 21, and achieving direct positioning between the primary optical element 11 and the secondary optical element 21. Moreover, the contact between the front positioning surface (the front end surface of the support frame 1201) of the primary optical element holder 12*c* and the front surfaces 2211*c* of the inner sides of the insertion slots 221*c* of the secondary optical element holder 22*c* restricts forward movement of the primary optical element holder 12*c* relative to the secondary optical element holder 22*c*; the contact between the upper positioning surface (the top surfaces of the limiting pieces 1202) of the primary optical element holder 12*c* and the upper surfaces 2212*c* of the inner sides of the insertion slots 221*c* restricts upward movement of the primary optical element holder 12*c* relative to the secondary optical element holder 22*c*; the contact between the lower positioning surface (the bottom surface of the support frame 1201) of the primary optical element holder 12*c* and the lower surfaces 2213*c* of the inner sides of the insertion slots 221*c* restricts downward movement of the primary optical element holder 12*c* relative to the secondary optical element holder 22*c*; the respective contact between the opposite inner side surfaces of the two clamping parts 1206 on the primary optical element holder 12*c* and the left and right side surfaces of the secondary optical element holder 22*c* restricts left-right movement of the primary optical element holder 12*c* relative to the secondary optical element holder 22*c*; the contact and cooperation between the rear positioning surface (the rear end surface of the support frame 1201) of the primary optical element holder 12*c* and the surface of the circuit board 4, and the contact and cooperation between the protruding parts 227 at the rear end of the secondary optical element holder 22*c* and the surface of the circuit board 4 restrict backward movement of the primary optical element holder 12*c* relative to the secondary optical element holder 22*c*, so that the relative fixation of the primary optical element holder 12*c* and the secondary optical element holder 22*c* in the front-rear, up-down, and left-right directions can be ensured, and the omnidirectional positioning accuracy and installation stability of the primary optical element holder 12*c* and the secondary optical element holder 22*c* can be ensured, i.e., the positioning accuracy and installation stability of the primary optical element 11 and the secondary optical element 21 can be ensured, so that the relative positions of the primary optical element 11 and the secondary optical element 21 can still remain unchanged after the vehicle lamp optical element assembly is used for a long time, thereby ensuring the accuracy and stability of the vehicle lamp light shape. In addition, after the primary optical element 11 and the secondary optical element 21 are assembled into an integral structure and the relative positions of the primary optical element 11 and the secondary optical element 21 are determined, the integral structure is mounted on the circuit board 4 and the radiator 3, so that the positioning accuracy requirement of the circuit board 4 and the radiator 3 may be reduced, and the installation process is easier and more convenient.

Structures for positioning and mounting the primary optical element holder 12*c* and the secondary optical element holder 22*c* to the radiator 3, the circuit board 4, and the light source 5 are involved in the prior art, and will not be described in detail herein.

In addition, it should be noted that at least one light entrance part arranged at the rear end surface of the primary optical element 11 in the embodiment is not shown in the figures.

Third Embodiment of the Vehicle Illumination Module

The primary optical element holder 12*b* and the secondary optical element holder 22*b* are both fixedly connected with the radiator 3. The primary optical element holder 12*b* is arranged or integrally formed on the upper surface or the lower surface of the primary optical element 11, and the secondary optical element holder 22*b* is arranged or integrally formed on the upper and lower ends of the secondary optical element 21.

The vehicle illumination module of the embodiment may be a low beam module, a high beam module, or a dual-beam module. The difference lies in that vehicle lamp optical element assemblies of different structures are selected according to respective light shape requirements, and corresponding light distribution is performed.

Low Beam Module

Figure 56:
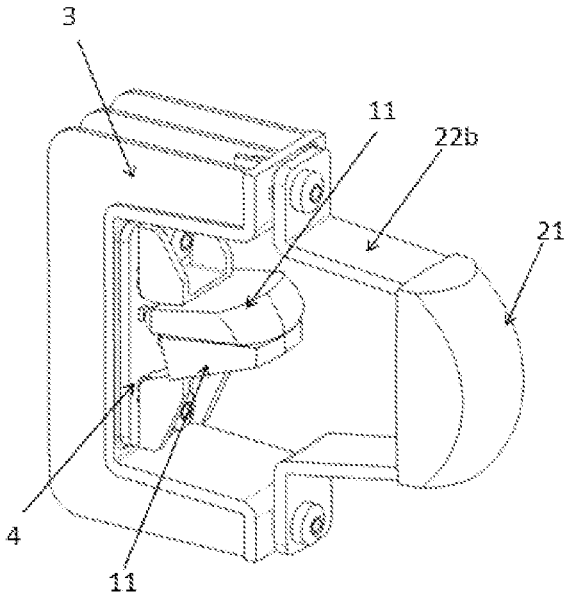
FIG. 56 is a schematic structural diagram of a dual-beam module in a specific embodiment of the present application.

Referring to FIGS. 43-49 and in conjunction with FIG. 56, a primary optical element holder 12*b* of the low beam module and the radiator 3 are positioned by a primary positioning device; a secondary optical element holder 22*b* and the radiator 3 are positioned by a secondary positioning device; a rear end surface of the primary optical element holder 12*b* is provided with a primary optical element holder mounting hole 121 to mount the primary optical element holder 12*b* on the radiator 3 and the circuit board 4; and a rear end surface of the secondary optical element holder 22*b* is provided with secondary optical element holder mounting holes 222*b* to mount the secondary optical element holder 22*b* on the radiator 3.

Specifically, the primary positioning device includes radiator primary positioning holes formed in the radiator 3, circuit board primary positioning holes formed in the circuit board 4, and primary optical element positioning pins 123*b* arranged on the primary optical element holder 12*b*, and the primary optical element positioning pins 123*b* pass through the circuit board primary positioning holes and cooperate with the radiator primary positioning holes to limit the primary optical element 11 on the radiator 3 and the circuit board 4; and the secondary positioning device includes secondary optical element holder positioning pins 224*b* arranged on the rear end surface of the secondary optical element holder 22*b*, and radiator secondary positioning holes formed in the radiator 3, and the secondary optical element holder positioning pins 224*b* cooperate with the radiator secondary positioning holes to limit the secondary optical element 21 on the radiator 3.

As shown in FIG. 56, the contour of the radiator 3 is right-angled-U-shaped, and the primary optical element holder 12*b* is mounted on an inner bottom surface of the right-angled-U-shaped radiator 3, and the secondary optical element holder 22*b* is mounted on two ends of the right-angled-U shaped radiator 3.

The low beam module may be used for a main low beam, and may also be used for an auxiliary low beam, and the primary optical element 11 of the low beam module has the same structure as the primary optical element 11 in the above-mentioned auxiliary low beam module. The primary optical element holder 12*b* of the low beam module is located on the upper surface of the primary optical element 11, and a transverse section line of a light emergent surface 114 of the primary optical element 11 of the low beam module is configured as a forward protruding arc, and a longitudinal section line of the low beam module is configured as a straight line or a forward protruding arc.

Figure 50:
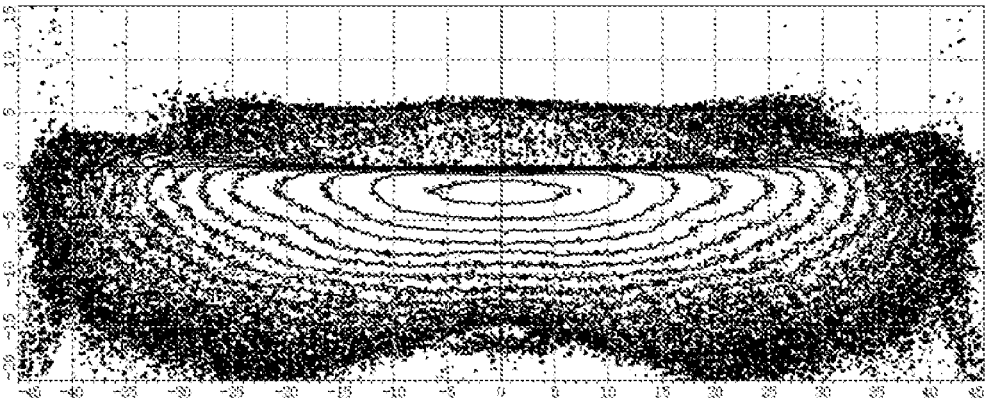
FIG. 50 is a schematic diagram of a light shape formed by projection of a low beam module in a specific embodiment of the present application.
Figure 51:
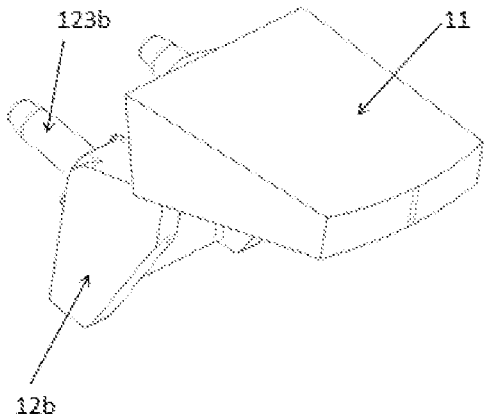
FIG. 51 is a schematic structural diagram of a primary optical element and a primary optical element holder of a high beam module in a specific embodiment of the present application.

A light shape formed by projection of the low beam module is as shown in FIG. 50.

High Beam Module

Referring to FIGS. 51-54 and in conjunction with FIG. 56, the structure of the high beam module is substantially the same as that of the low beam module, and differs in that: a primary optical element holder 12*b* is located on the lower surface of the primary optical element 11; a distance between upper and lower surfaces of the primary optical element 11 gradually decreases from rear to front, so that light converges in the up-down direction to form a high-brightness high beam light shape; and the primary optical element does not have a zone III structure 117.

Figure 55:
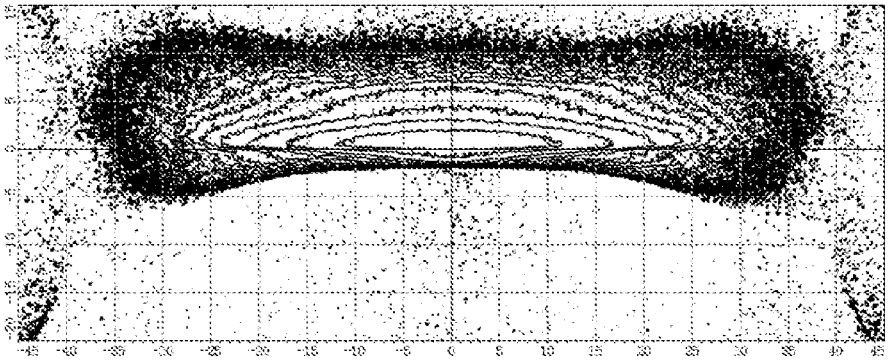
FIG. 55 is a schematic diagram of a light shape formed by projection of a high beam module in a specific embodiment of the present application.

A light shape formed by projection of the above-mentioned high beam module is as shown in FIG. 55.

Dual-Beam Module

Figure 57:
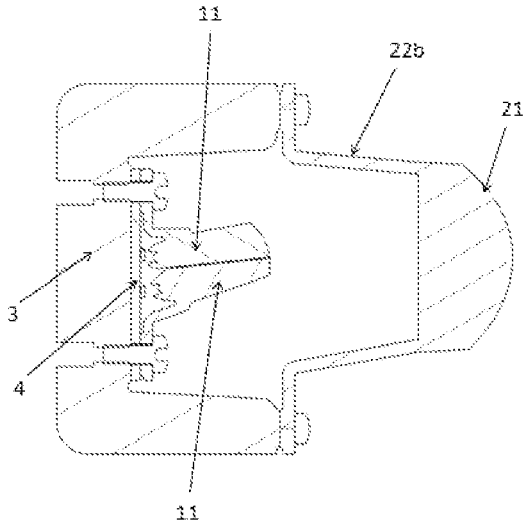
FIG. 57 is a longitudinal sectional diagram of FIG. 56.

Referring to FIGS. 56-57, the dual-beam module includes a primary optical element 11 of the above-mentioned low beam module, a primary optical element 11 of the above-mentioned high beam module, and a secondary optical element 21, and a radiator 3, a circuit board 4 and a light source 5 arranged successively from rear to front along a light emergent direction, wherein the two primary optical elements 11 are provided with positioning pins to be positioned together with the circuit board 4, and the secondary optical element 21 is provided with positioning pins to be positioned together with the radiator 3, and the two primary optical elements 11 and the secondary optical element 21 are respectively fixedly connected with the radiator 3. An overall dimension of the module is: 70-120 mm in the front-rear direction, 10-40 mm in the left-right direction, and 40-80 mm in the up-down direction.

Figure 58:
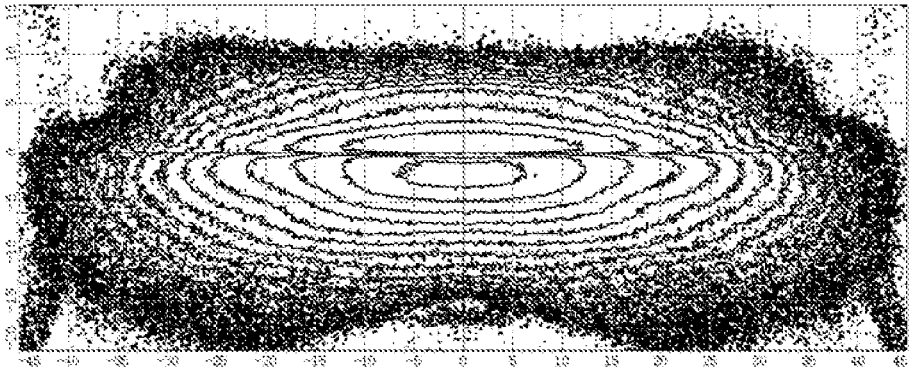
FIG. 58 is a schematic diagram of a light shape formed by projection of a dual-beam module in a specific embodiment of the present application.

A light shape formed by projection of the above-mentioned dual-beam module is as shown in FIG. 58.

In addition, the present application further provides a fourth embodiment of the vehicle illumination module. Referring to FIGS. 69-78, the vehicle illumination module includes a radiator (not shown in the figures), a circuit board (not shown in the figures), and module units, wherein each module unit includes a light source 5, a primary optical element 11 and a secondary optical element 21 arranged successively from rear to front along a light emergent direction; and 1-5 light sources are arranged in one single module unit.

The vehicle illumination module is provided with at least two module units, i.e., a main light type module unit and an auxiliary light type module unit; a light type of the main light type module unit covers a light type core area, so as to form a light shape of a low beam central area, and a light type of the auxiliary light type module unit covers the light type core area to form a light shape of a low beam widening area; and the main light type module unit and the auxiliary light type module unit cooperate with each other to form an illumination system with a complete light type.

A plurality of main light type module units, and also a plurality of auxiliary light type module units are provided; and the module units interact with each other, and can achieve an illumination function as a whole; and the module units can also separately achieve a partial illumination function as individual module units.

In each module unit, the secondary optical element 21 is a plano-convex lens, a height and a width of an opening of the plano-convex lens are both 5-20 mm; and a front-rear distance of the primary optical element 11 is 10-20 mm.

The primary optical element 11 is provided with a light entrance part 112, a light transmission part 113 and a light exit part 114 successively along a light emergent direction, wherein an upper surface or a lower surface of the light transmission part 113 is configured as a reflective part; an upper boundary or a lower boundary of the light exit part 114 is configured as a cutoff part 115; and light emitted by the light source 5 first enters the primary optical element 11 from the light entrance part 112, and then irradiates toward the light exit part 114.

A length of the light transmission part 113 is 10-20 mm.

The light exit part 114 is configured as a smooth concave arc surface without a segment difference.

A radius R of a radian Fs of the arc is less than or equal to 20 mm, for cooperating with the lens of the secondary optical element 21; the cutoff part 115 is arranged at a boundary of the light exit part 114; and a focal point of the lens is arranged at the boundary, or is no more than 2 mm from the boundary.

Structures for forming a low beam zone III light shape area and a 50 L light shape area are arranged at a reflective part of the primary optical element 11 of the low beam module, wherein a 50 L structure is a concave cavity (i.e., a recessed part 116), which is arranged at a part close to the cutoff part 115; and a zone III structure 117 is arranged in a middle segment of the reflective part, has a wedge-shaped structure and a thickness gradually increasing from rear to front, and has a light emergent surface which is a concave curved surface, wherein the word "concave" means being concave toward the rear end.

The main light type module unit includes two types: a main low beam module I and a main low beam module II. The light type module units in the embodiment will be described below respectively.

Main Low Beam Module I

Figure 69:
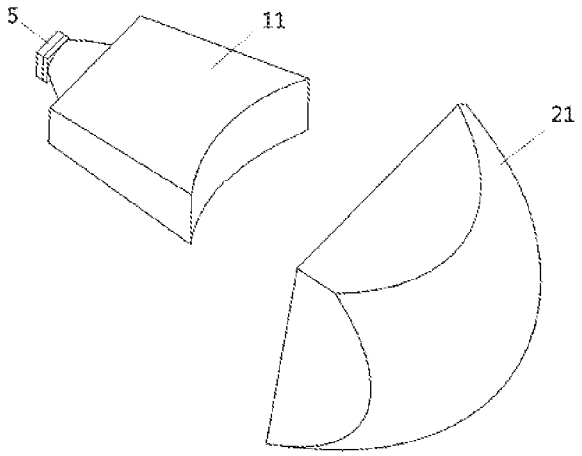
FIG. 69 is a three-dimensional structural diagram of a main low beam module I in a specific embodiment of the present application.
Figure 70:
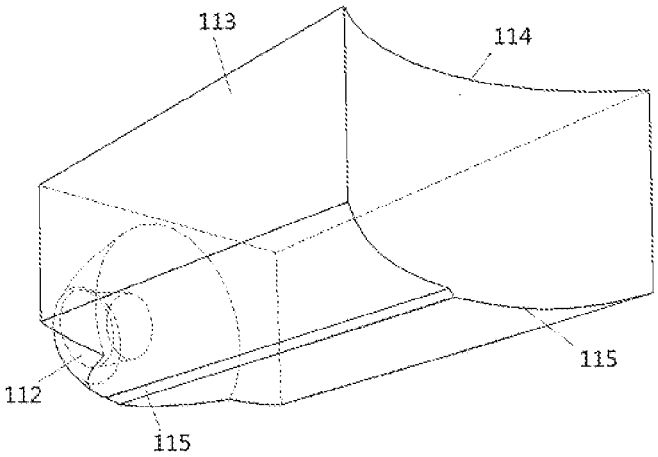
FIG. 70 is a three-dimensional structural diagram of a primary optical element of a main low beam module I in a specific embodiment of the present application.
Figure 71:
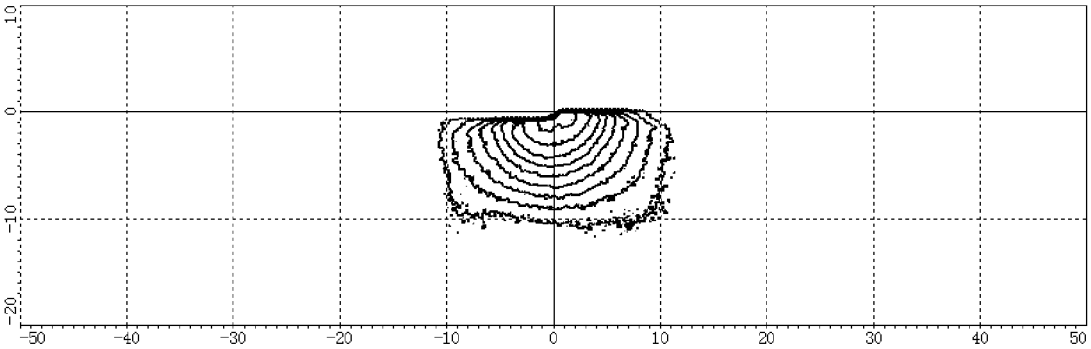
FIG. 71 is a schematic diagram of a light shape formed by projection of a main low beam module I in a specific embodiment of the present application.
Figure 72:
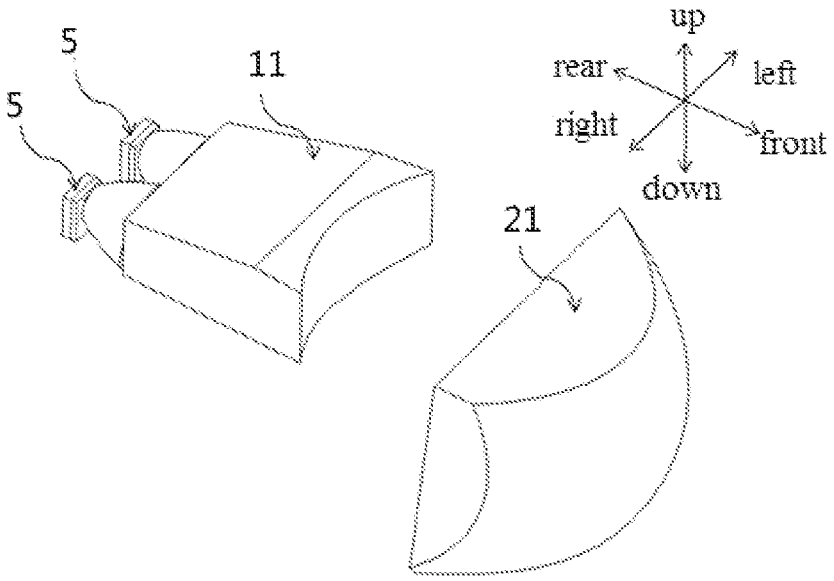
FIG. 72 is a three-dimensional structural diagram of a main low beam module II in a specific embodiment of the present application.

Two main low beam modules I are provided. As shown in FIGS. 69 and 70, the number of the light source 5 and the number of the light entrance part 112 of the primary optical element 11 are both one; the secondary optical element 21 is a plano-convex lens, a height (up-down direction) and a width (left-right direction) of the opening of the lens being about 5-20 mm (preferably 10 mm); the light source 5 is a single chip LED light source; the light entrance part 112 is a condenser-cup-like structure; the lower surface of the light transmission part 113 is configured as a reflective part, and the reflective part is configured as a segmented surface with a left-right segment difference; the light exit part 114 is configured as an arc surface with a radius R of 10 mm; an intersection part of the reflective part and the light exit part 114 is configured as a cutoff part 115, and a shape of the cutoff part 115 is a shape of a low beam cutoff line with a left-right height difference, for forming a main low beam light shape with a cutoff line shape, as shown in FIG. 71.

Figure 77:
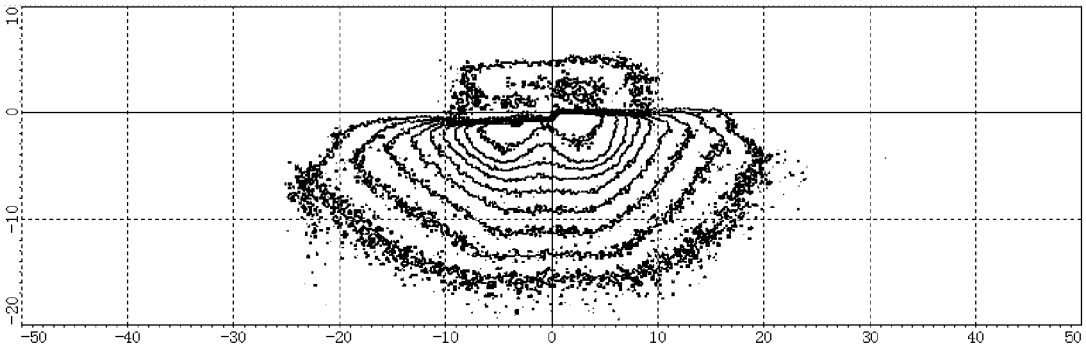
FIG. 77 is a light shape diagram of a main low beam module II in a specific embodiment of the present application.

Main Low Beam Module II:

Two main low beam modules II are provided. As shown in FIGS. 72-76, differences between the main low beam modules II and the main low beam modules I lie in that: the number of the light source 5 and the number of the light entrance part 112 of the primary optical element 11 in each main low beam module II are both two; the secondary optical element 21 is a lens, an opening of which has a height (up-down direction) of about 8-12 mm, and a width (left-right direction) of about 13-17 mm; the light sources 5 and the light entrance parts 112 of the primary optical element 11 have inclination angles with respect to a central axis, and the light sources 5 on two sides of the primary optical element 11 and the light entrance parts 112 of the primary optical element 11 are inclined toward the middle; that is to say, optical axes of the light entrance parts 112 on the two sides of the primary optical element 11 are inclined toward a direction getting closer to an optical axis 211 of the secondary optical element to form a light shape as shown in FIG. 77.

A light shape formed by projection of the above-mentioned main low beam modules I and main low beam modules II superposed is as shown in FIG. 78.

Differences between an auxiliary light type module and a main light type module belong to conventional settings in the prior art, are not the innovative points of the present application, and thus will not be described in detail herein.

In a third aspect, the present application provides a vehicle lamp, which includes any vehicle illumination module described above.

In a fourth aspect, the present application provides a vehicle, which includes any vehicle lamp described above.

The preferred embodiments of the present application are described above in detail with reference to the accompanying drawings. However, the present application is not limited to the specific details in the above embodiments. Within the scope of the technical concept of the present application, various simple modifications can be made to the technical solutions of the present application, and these simple modifications are all encompassed within the protection scope of the present application.

In addition, it should be noted that the various specific technical features described in the above-mentioned specific embodiments can be combined in any suitable manner under the circumstance of no confliction. To avoid unnecessary repetition, various possible combinations will not be described separately in the present application.

In addition, various different embodiments of the present application may also be combined optionally, and the combinations should also be regarded as contents disclosed in the present application so long as they do not depart from the concept of the present application.

The invention claimed is:

1. A vehicle illumination module, comprising:

a radiator;

a circuit board;

a light source; and a vehicle lamp optical element assembly comprising a primary optical element and a secondary optical element, wherein light passes through the primary optical element and the secondary optical element successively and then is projected to form an illuminating light shape, the primary optical element comprising at least two light entrance parts, a light transmission part and a light exit part arranged successively along a light emergent direction, wherein optical axes of the light entrance parts on two sides of the primary optical element are inclined toward an optical axis of the secondary optical element, and the light exit part is a concave arc surface;

said radiator, circuit board, light source, and vehicle lamp optical element assembly being arranged successively from rear to front along a light emergent direction, wherein:

the light source is electrically connected to the circuit board; and the vehicle illumination module further comprises a primary optical element holder for supporting the primary optical element, and a secondary optical element holder for supporting the secondary optical element;

and wherein:

the primary optical element holder and the secondary optical element holder are connected in a pluggable manner, so as to fix relative positions of the primary optical element and the secondary optical element; and the secondary optical element holder is fixedly connected to the radiator.

2. The vehicle illumination module according to claim 1, wherein the secondary optical element holder is configured as a light-shielding hood, which is integrally formed with the secondary optical element by double-shot molding.

3. The vehicle illumination module according to claim 2, further comprising openings formed between upper and lower ends of the secondary optical element and the secondary optical element holder.

4. The vehicle illumination module according to claim 1, wherein:

the primary optical element holder comprises insertion positioning parts formed on two sides of the primary optical element; and the secondary optical element holder is provided with insertion slots for insertion of the insertion positioning parts, wherein:

the insertion slots run through a rear end of the secondary optical element holder and extend from rear to front;

front end surfaces of the insertion positioning parts are in contact with front surfaces of inner sides of the corresponding insertion slot, and rear end surfaces of the insertion positioning parts are in contact with a surface of the circuit board; and top surfaces of the insertion positioning parts are in contact with upper surfaces of the inner sides of the insertion slots, and bottom surfaces of the insertion positioning parts are in contact with lower surfaces of the inner sides of the insertion slots.

5. The vehicle illumination module according to claim 4, wherein arc-shaped baffles are arranged at left and right inner sides of a front end of the secondary optical element holder.

6. The vehicle illumination module according to claim 4, wherein:

the radiator is provided with radiator positioning pins, and the primary optical element is provided with primary optical element positioning holes cooperative with the radiator positioning pins;

the number of the primary optical element positioning holes is two, one of the primary optical element positioning holes being a circular hole in contact with a peripheral surface of the corresponding radiator positioning pin; and the primary optical element is provided with a vent hole that communicates the circular hole with the outside.

7. The vehicle illumination module according to claim 1, wherein:

the primary optical element holder comprises a support frame and a limiting piece, the limiting piece being fixedly arranged on the primary optical element, the support frame being provided with a limiting slot, the limiting piece being cooperatively connected with the limiting slot and fixed relative to the support frame; and the secondary optical element holder is provided with insertion slots, and the primary optical element holder cooperates with the insertion slots in a pluggable manner.

8. The vehicle illumination module according to claim 7, wherein:

the insertion slots run through a rear end of the secondary optical element holder and extend from rear to front;

a front end surface of the support frame is in contact with front surfaces of inner sides of the insertion slots, and a rear end surface of the support frame is in contact with a surface of the circuit board;

top surfaces of the limiting pieces are in contact with upper surfaces of the inner sides of the insertion slots; and a bottom surface of the support frame is in contact with lower surfaces of the inner sides of the insertion slots.

9. The vehicle illumination module according to claim 8, wherein a clamping part is arranged at left and right sides of the support frame respectively, and opposite inner side surfaces of the two clamping parts are respectively in contact with left and right side surfaces of the secondary optical element holder.

10. A vehicle lamp comprising the vehicle illumination module according to claim 1.

11. The vehicle lamp according to claim 10, wherein a lower surface of the primary optical element is inclined rearward and downward with respect to the optical axis of the secondary optical element, with an inclination angle of less than or equal to 15°.

12. The vehicle lamp according to claim 10, wherein a distance between upper and lower surfaces of the primary optical element gradually decreases from rear to front.

13. The vehicle illumination module according to claim 1, wherein a lower surface of the primary optical element is inclined rearward and downward with respect to the optical axis of the secondary optical element, with an inclination angle of less than or equal to 15°.

14. The vehicle illumination module according to claim 1, wherein a distance between upper and lower surfaces of the primary optical element gradually decreases from rear to front.

* * * * *